US009556595B2

(12) United States Patent
Congdon et al.

(10) Patent No.: US 9,556,595 B2
(45) **Date of Patent: *Jan. 31, 2017**

(54) HIGH PERFORMANCE IMPLEMENT WEAR MEMBER

(71) Applicant: Caterpillar Inc., Peoria, IL (US)

(72) Inventors: Thomas Congdon, Dunlap, IL (US); Sudhir R. Kallu, Peoria, IL (US); Nick W. Biggs, Princeville, IL (US); Nathan Bjerke, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/799,839

(22) Filed: Jul. 15, 2015

(65) Prior Publication Data

US 2016/0040399 A1 Feb. 11, 2016

Related U.S. Application Data

(60) Provisional application No. 62/033,310, filed on Aug. 5, 2014.

(51) Int. Cl.

| | |
|---|---|
| ***E02F 3/815*** | (2006.01) |
| ***E02F 9/28*** | (2006.01) |
| ***E02F 3/65*** | (2006.01) |

(52) U.S. Cl.

CPC ..... *E02F 9/2883* (2013.01); *E02F 3/658* (2013.01); *E02F 3/8152* (2013.01); *E02F 9/2858* (2013.01); *E02F 9/2875* (2013.01)

(58) Field of Classification Search

CPC ..... E02F 3/76; E02F 3/815; E02F 3/8152; E02F 9/28; E02F 9/2883; E02F 9/2875; E02F 9/2858; E02F 3/658

USPC ..... 37/444, 446, 448; 172/701.2, 772.5, 753

See application file for complete search history.

(56) References Cited

U.S. PATENT DOCUMENTS

| | | | |
|---|---|---|---|
| 2,732,639 | A | 1/1956 | Lillengreen |
| 2,831,275 | A | 4/1958 | Kimsey et al. |
| 2,914,868 | A | 12/1959 | Launder |
| 2,965,989 | A | 12/1960 | Hibbard |
| 3,029,534 | A | 4/1962 | Rakisits |
| 3,289,331 | A | 12/1966 | Freeman |

(Continued)

FOREIGN PATENT DOCUMENTS

| | | | |
|---|---|---|---|
| GB | 1117386 | A | 6/1968 |
| JP | 2012-7449 | A | 1/2012 |

(Continued)

*Primary Examiner* — Robert Pezzuto

(74) *Attorney, Agent, or Firm* — Leydig, Voit & Mayer, Ltd.

(57) ABSTRACT

A wear member for an earth-working implement includes a body having front, rear, top, bottom, inner side and outer side portions. A cutting edge is defined along at least a portion of a bottom interface. The wear member includes a contoured upper front surface, which extends between a top edge along a top interface between the front portion and the top portion, an outer side edge along an outer side interface between the front portion and the outer side portion, a ridge on the front portion, and a spearhead edge along the bottom interface. The wear member includes a contoured lower front surface formed on the front portion of the body adjacent the contoured upper front surface, which is between an inner side edge, which is disposed along an inner side interface between the front portion and the inner side portion, the cutting edge, and the ridge.

22 Claims, 23 Drawing Sheets

(56) References Cited

U.S. PATENT DOCUMENTS

| | | | |
|---|---|---|---|
| 3,456,370 | A | 7/1969 | Gilbertson |
| 3,465,833 | A | 9/1969 | Lutz |
| 3,638,736 | A | 2/1972 | Hahn |
| 3,736,676 | A | 6/1973 | Sturgeon |
| 3,851,711 | A | 12/1974 | Stepe |
| 3,961,788 | A | 6/1976 | Helton et al. |
| 4,037,337 | A | 7/1977 | Hemphill |
| 4,086,967 | A | 5/1978 | Eftefield et al. |
| 4,390,071 | A | 6/1983 | Wright |
| 6,470,606 | B1 | 10/2002 | Nagahiro et al. |
| 6,854,201 | B1 | 2/2005 | Hunter et al. |
| 6,938,701 | B2 | 9/2005 | Matsumoto et al. |
| 7,874,085 | B1 | 1/2011 | Winter et al. |
| 8,191,287 | B2 | 6/2012 | Winter et al. |
| 8,689,897 | B2 | 4/2014 | May |
| 8,783,376 | B2 | 7/2014 | Congdon et al. |
| 2005/0098332 | A1 | 5/2005 | Matsumoto et al. |
| 2009/0321097 | A1 | 12/2009 | Matsumoto et al. |
| 2011/0162241 | A1 | 7/2011 | Wangsness |
| 2014/0041886 | A1 | 2/2014 | Congdon et al. |

FOREIGN PATENT DOCUMENTS

| | | | |
|---|---|---|---|
| JP | 2001-040692 | A | 2/2012 |
| WO | WO 2004/044337 | A1 | 5/2004 |
| WO | WO 2013/112102 | A1 | 8/2013 |
| WO | 2015031090 | | 3/2015 |

HIGH PERFORMANCE IMPLEMENT WEAR MEMBER

CROSS-REFERENCE TO RELATED APPLICATIONS

This patent application claims the benefit of priority to U.S. Provisional Patent Application No. 62/033,310, filed on Aug. 5, 2014, and entitled "High Performance Implement Wear Member," which is incorporated in its entirety herein by reference.

TECHNICAL FIELD

This disclosure relates generally to ground engaging tools and, more particularly, to ground engaging tools on buckets, blades, and other work tools used with mining and construction machinery.

BACKGROUND

Different types of mining and construction machines, such as tractors, bulldozers, backhoes, excavators, motor graders, and mining trucks commonly employ earth-working blades to move and level earth or materials being excavated or loaded. The earth-working blades frequently experience extreme wear from repeated contact with highly abrasive materials encountered during operation. Replacement of the earth-working blades and other implements used in mining and construction machinery can be costly and labor intensive.

The earth-working blades can be equipped with a ground engaging tool (GET), such as a cutting-bit or a set of cutting-bits, to help protect the blade and other earth-working tools from wear. Typically, a cutting-bit can be in the form of teeth, edge protectors, tips, or other removable components that can be attached to the areas of the blade or other tool where most damaging and repeated abrasions and impacts occur. For example, a GET in the form of edge protectors can wrap around an implement's cutting edge to help protect it from excessive wear.

In such applications, the removable cutting-bits can be subjected to wear from abrasion and repeated impact, while helping to protect the blade or other implement to which they can be mounted. When the cutting-bit becomes worn through use, it can be removed and replaced with a new cutting-bit or other GET at a reasonable cost to permit the continued use of the implement. By protecting the implement with a GET and replacing the worn GET at appropriate intervals, significant cost and time savings are possible.

The cost and time savings available from using a cutting-bit to protect large machine implements can be further enhanced by increasing the ability of the cutting-bit to cut through the working material. In many applications, a machine must make a pass using a first implement, such as a ripper or other cutting tool, to cut the earth or other working material before making another pass with a second implement, such as a blade, to move the material. Thus, an implement system able to cut the working material and move the material with a blade using fewer passes can result in increased work efficiency. There is an ongoing need in the art for an improved cutting-bit system that increases the efficiency of earth-working machinery and increases productivity.

It will be appreciated that this background description has been created by the inventors to aid the reader, and is not to be taken as an indication that any of the indicated problems were themselves appreciated in the art. While the described principles can, in some respects and embodiments, alleviate the problems inherent in other systems, it will be appreciated that the scope of the protected innovation is defined by the attached claims, and not by the ability of any disclosed feature to solve any specific problem noted herein.

SUMMARY

In an embodiment, the present disclosure describes a wear member for an earth-working implement. The wear member includes a body having front, rear, top, bottom, inner side and outer side portions. A cutting edge is defined along at least a portion of a bottom interface between the front portion and the bottom portion. The wear member includes a contoured upper front surface defined on the front portion. The contoured upper front surface extends between a top edge disposed along a top interface between the front portion and the top portion, an outer side edge disposed along an outer side interface between the front portion and the outer side portion, a ridge disposed on the front portion, and spearhead edge disposed along the bottom interface between the outer side portion and the cutting edge. The wear member also includes a contoured lower front surface formed on the front portion of the body adjacent the contoured upper front surface. The contoured lower front surface is defined between an inner side edge, which is disposed along an inner side interface between the front portion and the inner side portion, the cutting edge, and the ridge.

In another embodiment, the present disclosure describes a wear member for an earth-working implement. The wear member includes a body having front, rear, top, bottom, inner side and outer side portions. A cutting edge is defined along at least a portion of a bottom interface between the front portion and the bottom portion. The wear member includes a contoured upper front surface defined on the front portion. The contoured upper front surface extends between a top edge disposed along a top interface between the front portion and the top portion, an outer side edge disposed along an outer side interface between the front portion and the outer side portion, a ridge disposed on the front portion, and a spearhead edge disposed along the bottom interface between the outer side portion and the cutting edge. The wear member includes a bottom surface defined on the bottom portion of the body. The bottom surface extends between the spearhead edge, the cutting edge, an outer bottom edge disposed along an outer bottom interface between the bottom portion and the outer side portion, a rear bottom edge disposed along a rear bottom interface between the rear portion and the bottom portion, and an inner bottom edge disposed along an inner bottom interface between the bottom portion and the inner side portion. The contoured upper front surface has a generally concave shape. Additionally, a spearhead edge angle, measured between the contoured upper front surface and the bottom surface with respect to the spearhead edge, is less than about 90 degrees.

In another embodiment, the present disclosure describes a wear member system for an earth-working implement. The wear member system includes at least one end cutting-bit adapted to be mounted to a mounting edge of an earth-working blade. The mounting edge is defined between a first blade end and a second blade end. The at least one end cutting-bit includes a body having front, rear, top, bottom, inner side and outer side portions, wherein a cutting edge is defined along at least a portion of a bottom interface between the front portion and the bottom portion. The end cutting-bit also includes a contoured upper front surface defined on the front portion. The contoured upper front surface extends between a top edge disposed along a top interface between the front portion and the top portion, an outer side edge disposed along an outer side interface between the front portion and the outer side portion, a ridge disposed on the front portion, and a spearhead edge disposed along the bottom interface between the outer side portion and the cutting edge. The end cutting-bit also includes a contoured lower front surface formed on the front portion of the body adjacent the contoured upper front surface. The contoured lower front surface defined between an inner side edge, which is disposed along an inner side interface between the front portion and the inner side portion, the cutting edge, and the ridge. The wear member system also includes at least one intermediate cutting-edge adapted to be mounted along the mounting edge of the earth-working blade between the first blade end and the second blade end.

Further and alternative aspects and features of the disclosed principles will be appreciated from the following detailed description and the accompanying drawings. As will be appreciated, the principles related to end cutting-bits disclosed herein are capable of being carried out in other and different embodiments, and capable of being modified in various respects. Accordingly, it is to be understood that both the foregoing general description and the following detailed description are exemplary and explanatory only and do not restrict the scope of the appended claims.

DETAILED DESCRIPTION

Figure 1:
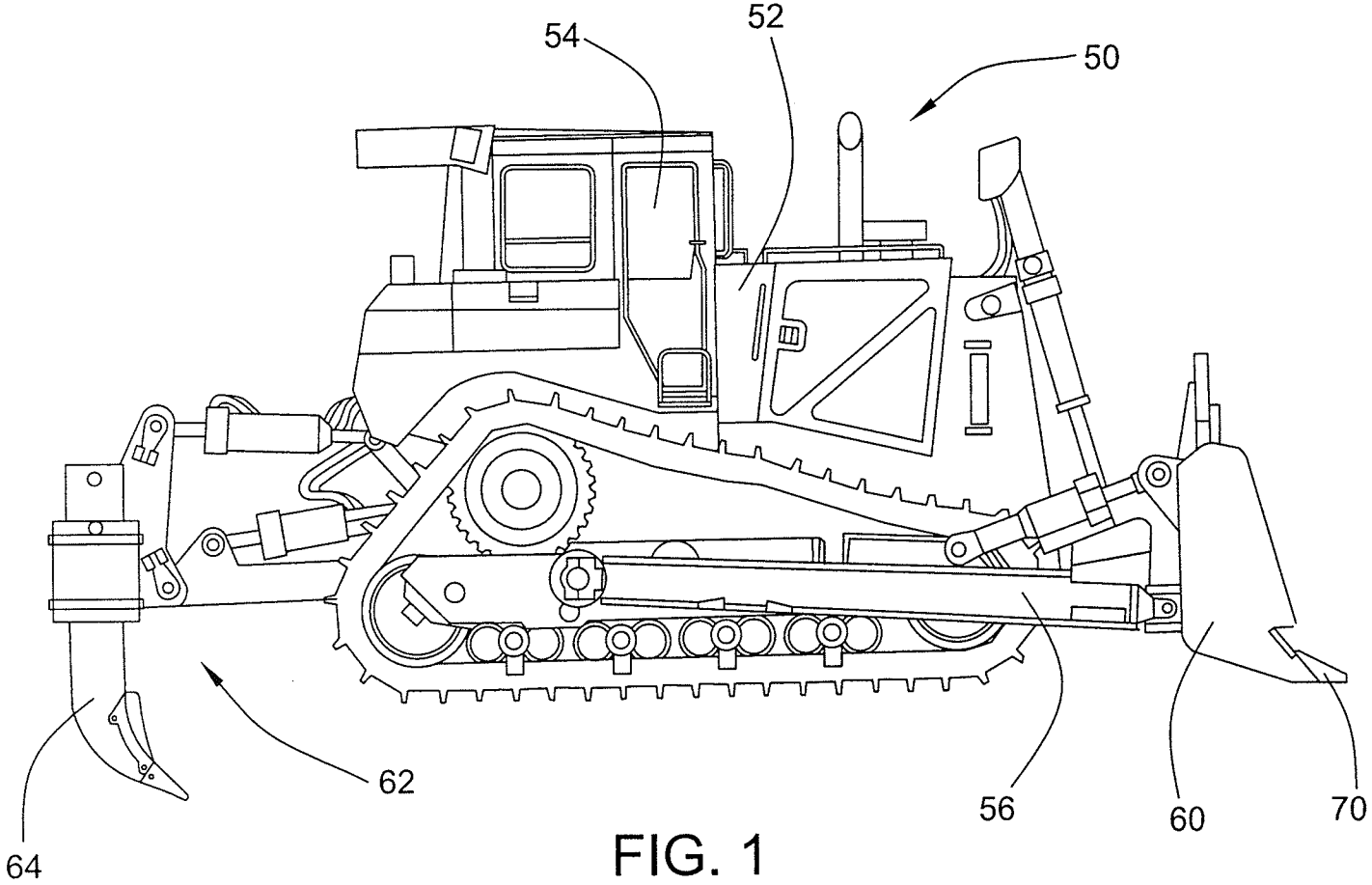
FIG. 1 is a diagrammatic side elevation view of an embodiment of a machine including an embodiment of an implement having an implement end cutting-bit constructed in accordance with principles of the present disclosure.

This disclosure relates to GET assemblies and systems, specifically implement wear members such as cutting-bits, utilized in various types of mining, earth-working, and construction machinery. FIG. 1 shows an embodiment of a machine 50 in the form of a track-type tractor that can include an embodiment of a wear member, specifically an implement end cutting-bit, constructed in accordance with principles of the present disclosure. Among other uses, a track-type tractor can be used to move and strip working material in various surface mining or other construction applications.

As shown in FIG. 1, the machine 50 can include a body 52 with a cab 54 to house a machine operator. The machine 50 can also include an arm system 56 pivotally connected at one end to the body 52 or undercarriage and supporting an implement assembly 60 at an opposing, distal end. In embodiments, the implement assembly 60 can include any suitable implement, such as an earth-working blade, or any other type of suitable device usable with an end cutting-bit 100. The illustrated machine 50 also includes a ripper assembly 62 having a ripper 64 opposite the implement assembly 60. The ripper 64 can be used to cut through and break up working material for removal. A control system can be housed in the cab 54 that can be adapted to allow a machine operator to manipulate and articulate the implement assembly 60 and/or the ripper assembly 62 for digging, excavating, or any other suitable application.

Figure 2:
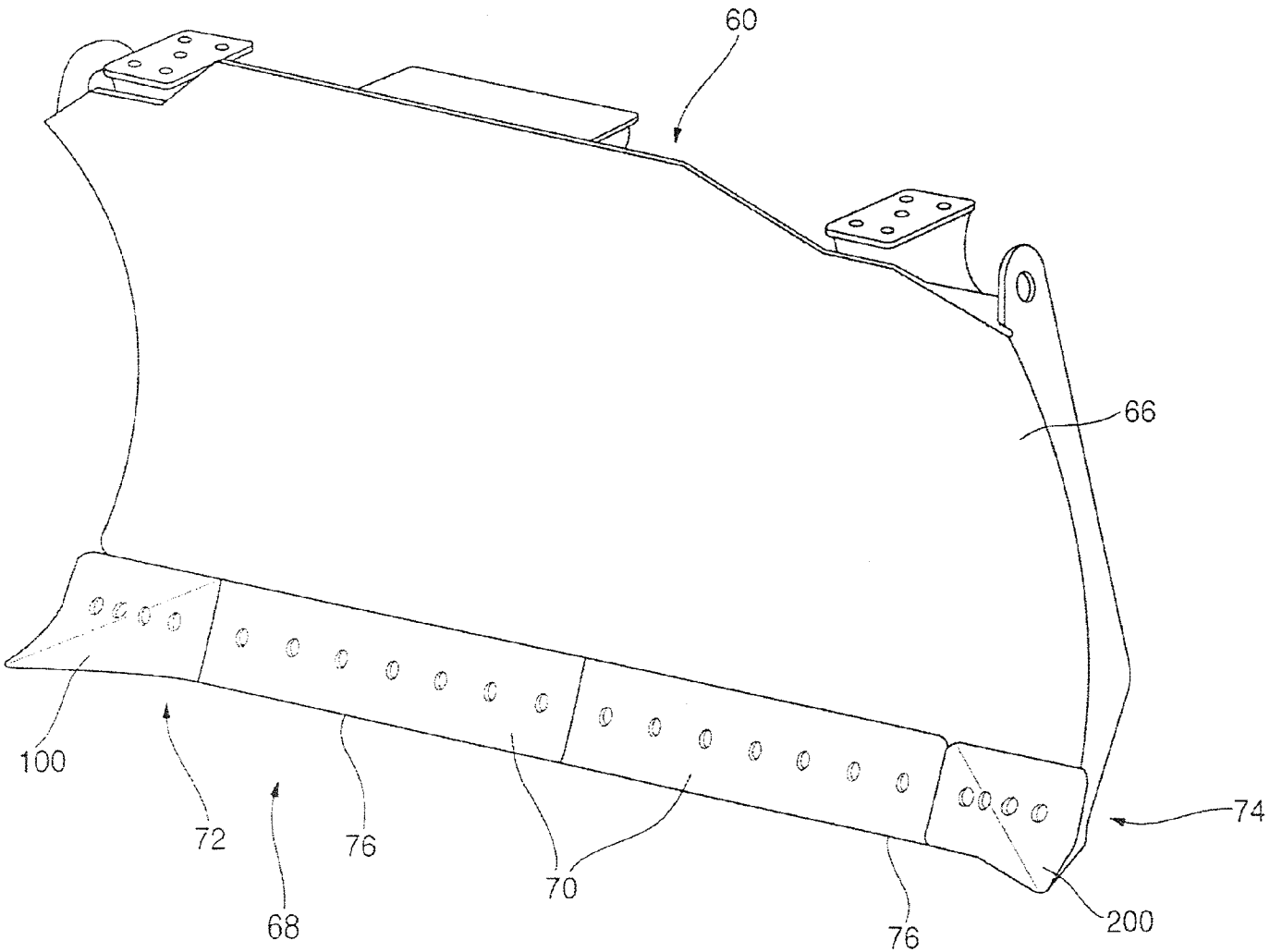
FIG. 2 is a perspective view of the implement of FIG. 1.

FIG. 2 shows an embodiment of the implement assembly 60. Referring to FIG. 2, the implement assembly 60 can include an earth-working implement, such as a blade 66, that can have a mounting edge 68 adapted to engage the ground or other excavation surface. The mounting edge 68 can be adapted to receive a plurality of wear members, including both intermediate cutting-edges 70 and end cutting-bits 100, 200. The end cutting-bits 100, 200 can be arranged on the mounting edge 68 at a first blade end 72 and a second blade end 74, respectively. In some embodiments, the end cutting-bit 100 mounted to the first blade end 72 of the mounting edge 68 can be symmetrical to the end cutting-bit 200 mounted to the second blade end 74 of the mounting edge 68. In the illustrated embodiment, the intermediate cutting-edges 70 can be mounted along the mounting edge 68 between the end cutting-bits 100, 200. Each intermediate cutting-edge 70 can have a cutting edge 76 that can contact the working material during machine operation. Although FIG. 2 illustrates two intermediate cutting-edges 70, it is contemplated that any number of intermediate cutting-edges of varying shapes and sizes can be used. In some embodiments, it is contemplated that no intermediate cutting-edges are used. Through repeated use, the end cutting-bits 100, 200 and the intermediate cutting-edges 70 can be subjected to wear and eventually can be replaced to allow the further use of the implement assembly 60. Additionally, although FIG. 2 shows wear members mounted to a flat blade, applications involving U-shaped blades or implements with other shapes are also contemplated herein.

Although FIGS. 1 and 2 illustrate the use of an end cutting-bit constructed in accordance with principles of the present disclosure with blade of a track-type tractor, many other types of implements and mining and construction machinery can benefit from using wear members as described herein. It should be understood that, in other embodiments, a wear member constructed in accordance with principles of the present disclosure can be used in a variety of other implements and/or machines.

Figure 3:
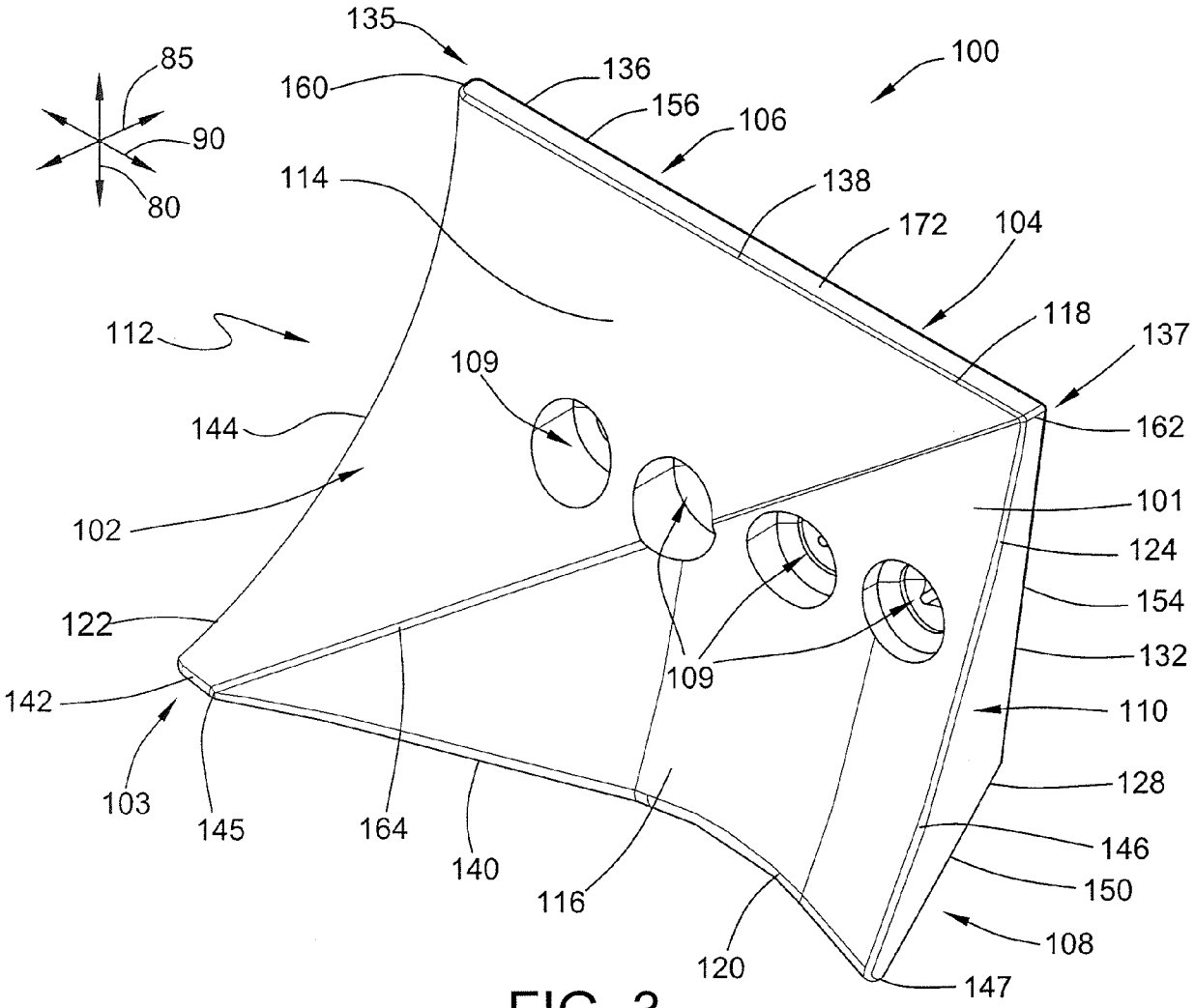
FIG. 3 is a front-left perspective view of an implement end cutting-bit constructed in accordance with the principles of the present disclosure.
Figure 4:
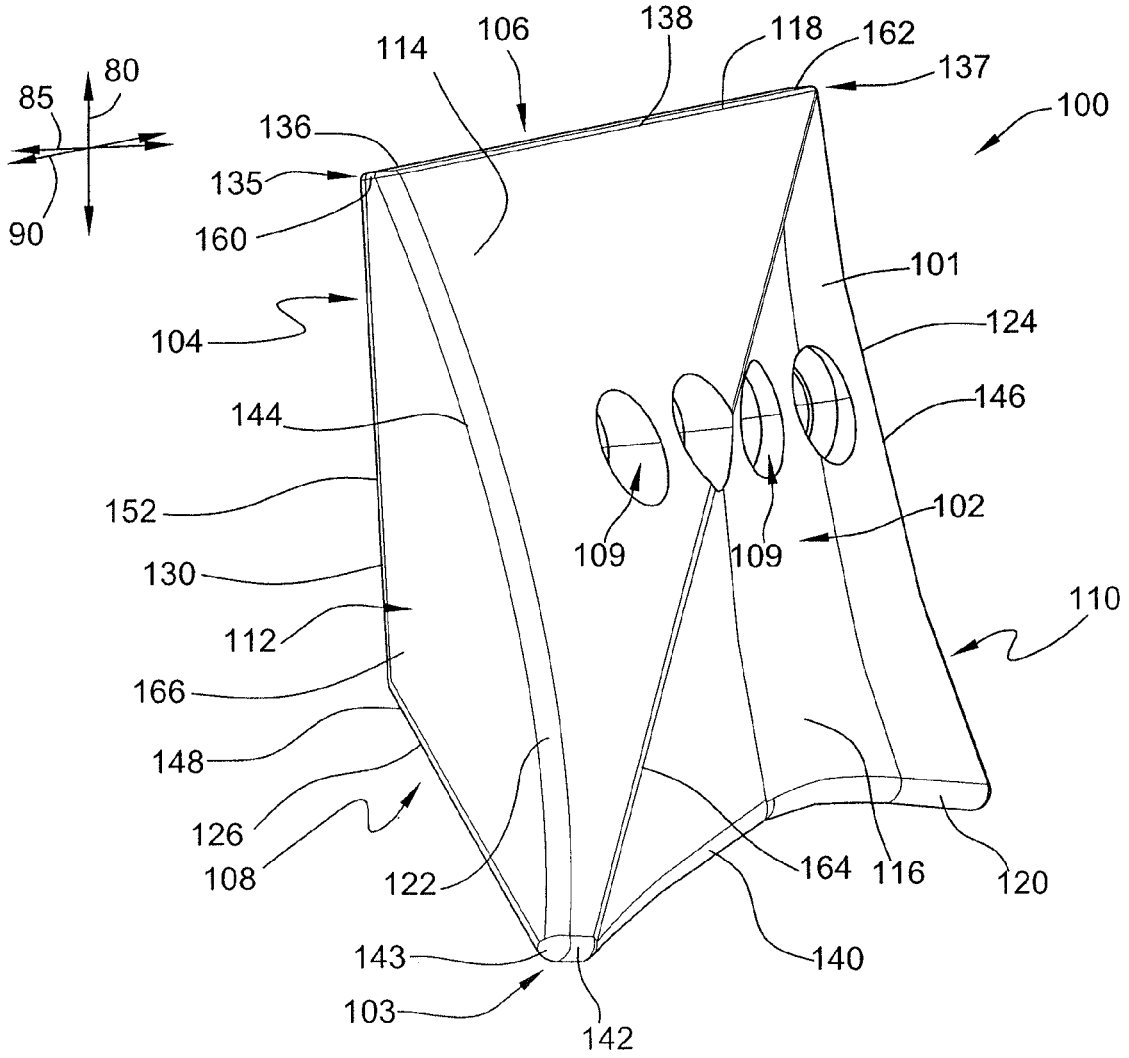
FIG. 4 is a front-right perspective view of the implement end cutting-bit of FIG. 3.
Figure 5:
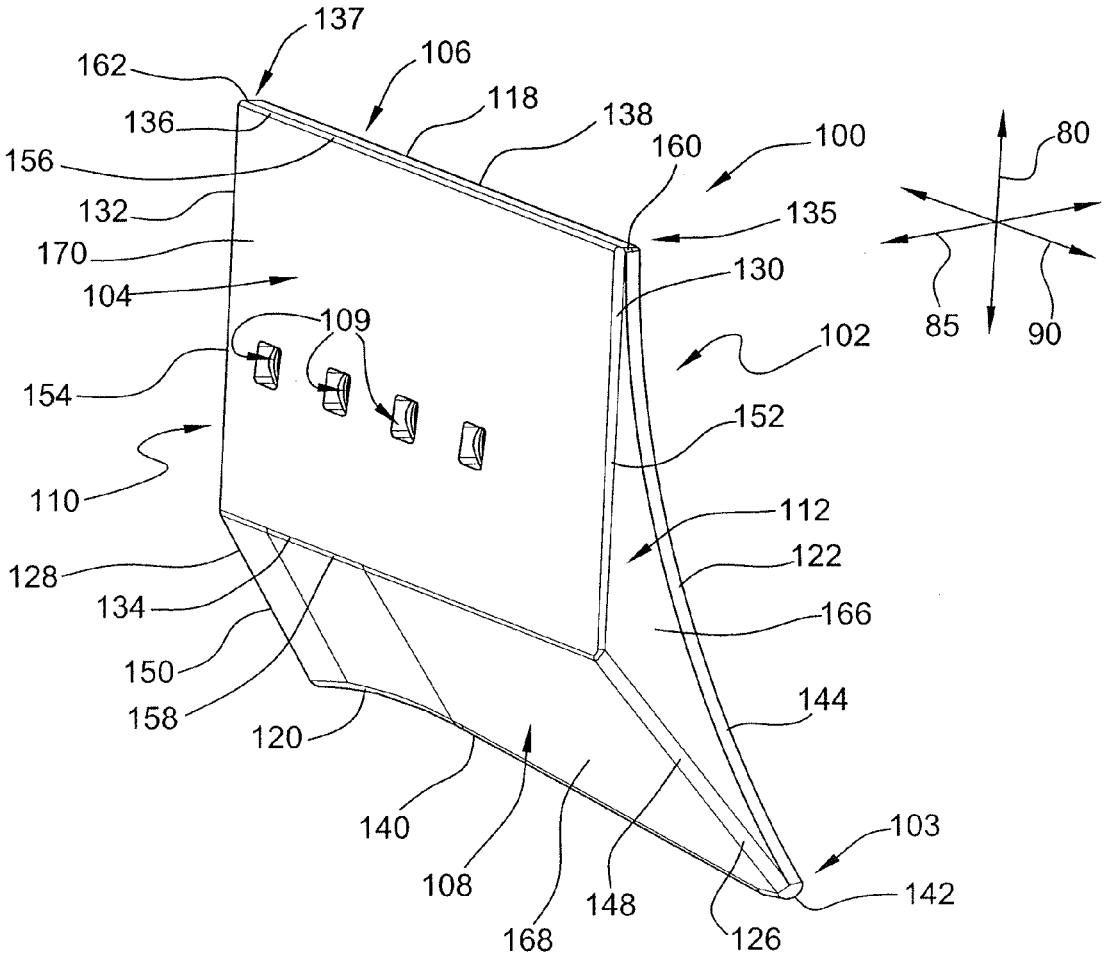
FIG. 5 is a rear-right perspective view of the implement end cutting-bit of FIG. 3.

FIGS. 3-5 illustrate perspective views of an embodiment of a wear member for an earth-working implement, specifically an end cutting-bit 100. The end cutting-bit 100 can be formed from a body 101 that can have a generally trapezoidal shape with a spearhead protrusion 103 on one corner. The shape of the end cutting-bit 100 disclosed herein with the spearhead protrusion 103 provides various benefits that improve the speed and efficiency in which a machine can excavate or clear work material. Specifically, the disclosed shape of the end cutting-bit 100 cuts through the surface of a work material such that a machine 50 equipped with a blade 66 having the disclosed end cutting-bit 100 can cut through and clear work material on a single pass. Such capability is an improvement over prior GET assemblies that require a machine to make a first pass using a ripper or other ground-cutting tool to break up the surface of the work material, then make a second pass with a blade or other implement to clear away the work material. Therefore, the disclosed end cutting-bit 100 can substantially reduce the number of passes required by an earth-clearing machine to clear an area, reducing the number of passes by up to half in some applications.

The body 101 can have a front portion 102, a rear portion 104, a top portion 106, a bottom portion 108, an inner side portion 110, and an outer side portion 112. Interfaces can exist between each of the adjacent portions. Specifically, a top interface 118 can exist between the top portion 106 and the front portion 102, and a bottom interface 120 can exist between the front portion and the bottom portion 108. An outer side interface 122 can exist between the front portion 102 and the outer side portion 112, and an inner side interface 124 can exist between the front portion and the inner side portion 110. An outer bottom interface 126 can exist between the bottom portion 108 and the outer side portion 112, and an inner bottom interface 128 can exist between the inner side portion 110 and the bottom portion. Additionally, an outer rear interface 130 can exist between the outer side portion 112 and the rear portion 104, and an inner rear interface 132 can exist between the inner side portion 110 and the rear portion. A rear bottom interface 134 can exist between the rear portion 104 and the bottom portion 108, and a rear top interface 136 can exist between the top portion 106 and the rear portion. Finally, in some embodiments, an outer top interface 135 can exist between the outer side portion 112 and the top portion 106, and an inner top interface 137 can exist between the inner side portion 110 and the top portion.

In some embodiments, a plurality of mounting holes 109 can be formed in the body 101, creating passages between the front portion 102 and the rear portion 104 of the body. The mounting holes 109 can be adapted to receive mounting hardware, such as bolts, screws, rivets, or other mounting tools suitable to secure the end cutting-bit 100 to an implement. In some embodiments, the mounting holes 109 can be countersunk to provide a smooth, flush surface on the front portion 102. While some of the illustrated embodiments show seven mounting holes 109 adapted to receive seven sets of mounting hardware, it is contemplated that any number of mounting holes can be used in other embodiments. It is also contemplated that alternative mounting methods can be used to mount the end cutting-bit 100 to an earth-working blade or other implement.

Each interface on the body 101 can define one or more edges that can define surfaces on the body. Specifically, a top edge 138 can be disposed along the top interface 118, and a cutting edge 140 can be disposed along at least a portion of the bottom interface 120 and extend between the inner side portion 110 and the spearhead protrusion 103. In some embodiments, the cutting edge 140 can curve concavely away from the front portion 102, defining an edge that curves away from the spearhead protrusion 103. A spearhead edge 142 can also be disposed along the bottom interface 120 and extend between the outer side portion 112 and the cutting edge 140, which can form the forward edge of the spearhead protrusion 103. An outer side edge 144 can be disposed along the outer side interface 122 between the top edge 138 and the spearhead edge 142, and an inner side edge 146 can be disposed along the inner side interface 124 extending between the top edge 138 and the cutting edge 140. The outer side edge 144 can have a concave curvature in certain embodiments. Additionally, the body 101 can include an outer bottom edge 148 disposed along the outer bottom interface 126 and extending between the spearhead edge 142 and the rear portion 104, and an inner bottom edge 150 disposed along the inner bottom interface 128 and extending between the cutting edge 140 and the rear portion. An outer rear edge 152 can be disposed along the outer rear interface 130 and extend between the top portion 106 and the outer bottom edge 148, and an inner rear edge 154 can be disposed along the inner rear interface 132 and extend between the top portion and the inner bottom edge 150. A rear top edge 156 can be disposed along the rear top interface 136 and extend between the outer rear edge 152 and the inner rear edge 154, and a rear bottom edge 158 can be disposed along the rear bottom interface 134 and extend between the outer rear edge and the inner rear edge. Further, in some embodiments, an outer top edge 160 can be defined along the outer top interface 135 and extend between the top edge 138 and the rear top edge 156, and an inner top edge 162 can be defined along the inner top interface 137 and extend between the top edge and the rear top edge. In the illustrated embodiments, the various edges can be chamfered to form rounded edges and corners to the body 101. It is contemplated, however, that the edges of the body 101 can have sharp corners, angled bevels, or any other suitable shape.

For the purpose of illustration, the figures indicate a normal axis 80, a lateral axis 90, and a longitudinal axis 85, all of which are defined perpendicular to one another. In FIGS. 3-5, for the purposes of illustration, the body 101 of the end cutting-bit 100 is aligned such that the outer top edge 160 and the inner top edge 162 can extend substantially along the longitudinal axis 85, and the top edge 138 can extend substantially along the lateral axis 90. In some embodiments, the inner rear edge 154 can extend substantially along the normal axis 80.

As best shown in FIGS. 3-4, the front portion 102 of the body 101 can define a contoured upper front surface 114 and a contoured lower front surface 116. A ridge 164 can also be disposed on the front portion 102 separating the contoured upper front surface 114 from the contoured lower front surface 116. In some embodiments, such as the embodiment illustrated in FIG. 6, the ridge 164 can extend along the front portion 102 between the inner top edge 162 and the spearhead edge 142. The contoured upper front surface 114 can form a generally trapezoidal concave depression on the front portion 102 of the body 101 that extends between the top edge 138, the outer side edge 144, the ridge 164, and the spearhead edge 142. In some embodiments, the contoured upper front surface 114 can have a curvature consistent across the contoured upper front surface. In other embodiments, the curvature of the contoured upper front surface can vary at different points along the surface. In some embodiments, the curvature of the contoured upper front surface 114 varies across the surface and can dictated by the geometry of the ridge 164, the outer side edge 144, the top edge 138, and the spearhead edge 142. It is also contemplated that, in some embodiments, the spearhead edge 142 can simply be a point and, in such embodiments, the contoured upper front surface 114 can have a generally triangular shape.

The contoured lower front surface 116 can form a generally triangular concave depression on the front portion 102 of the body 101 adjacent the contoured upper front surface 114. The generally concave shape of the contoured upper and lower front surfaces 114, 116 can help in directing work material debris away from the spearhead protrusion 103 as the end cutting-bit 100 passes through the work material. This can reduce work material build-up at the point of the end cutting-bit 100 that engages the work material, which can improve cutting and clearing efficiency. It is contemplated, however, that the contoured lower front surface 116 can have other shapes in other embodiments. The contoured lower front surface 116 can extend between the ridge 164, the inner side edge 146, and the cutting edge 140. In some embodiments, the end cutting-bit 100 can be mounted to an earth-working implement adjacent the intermediate cutting-edges 70 along the inner side portion 110 of the body 101. The shape and curvature of the contoured lower front surface 116 and the cutting edge 140 can vary in different embodiments of the end cutting-bit 100 depending on the dimensions of the particular intermediate cutting-edge used to ensure a smooth transition between the adjacent wear members mounted on an earth-working implement. Although the illustrated embodiments do not show a smooth transition between the end cutting-bits 100, 200 and the intermediate cutting-edges 70, it is contemplated that such a smooth transition can occur by varying the dimensions of the end cutting-bit or cutting edges.

The body 101 can also include an outer spearhead corner 143 and an inner spearhead corner 145. The outer spearhead corner 143 can be disposed at the junction between the outer side edge 144 and the spearhead edge 142, and the inner spearhead corner 145 can be disposed at the junction between the ridge 164, the spearhead edge 142, and the cutting edge 140. Additionally, the body 101 can include an inner side corner 147 disposed at the junction between the cutting edge 140, the inner side edge 146, and the inner bottom edge 150.

FIGS. 4-5 illustrate an outer side surface 166 that can be defined on the outer side portion 112 of the body 101. The outer side surface 166 can be disposed on the body 101 adjacent the contoured upper front surface 114 and extend between the outer side edge 144, the outer rear edge 152, and the outer bottom edge 148. In some embodiments, the outer side surface 166 can be flat; however, it is contemplated that the outer side surface can be non-flat in some embodiments, such as having a concave or convex shape.

Figure 11:
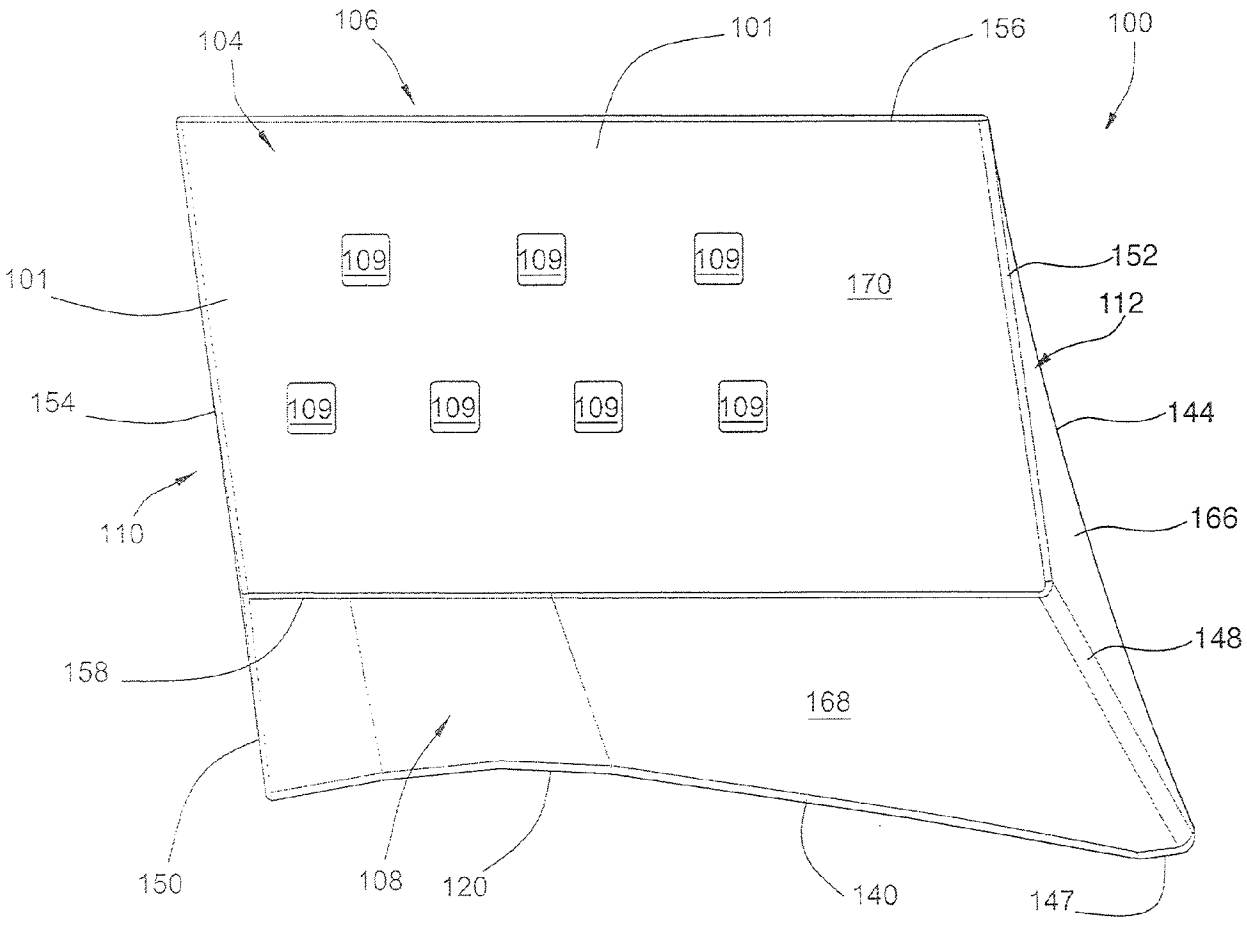
FIG. 11 is a rear view of the implement end cutting-bit of FIG. 3.

As illustrated in FIGS. 5 and 11, a bottom surface 168 can be defined on the bottom portion 108 of the body 101 and a rear surface 170 can be defined on the rear portion 104 of the body. The bottom surface 168 can be disposed on the body 101 adjacent the outer side surface 166 along the outer bottom edge 148. The bottom surface 168 further extends between the cutting edge 140, the spearhead edge 142, the inner bottom edge 150, and the rear bottom edge 158. In some embodiments, the bottom surface 168 is planar, while in other embodiments the bottom surface can be contoured or be made up of multiple planar surfaces. The rear surface 170 can be disposed on the rear portion 104 of the body 101 adjacent the bottom surface 168 along the rear bottom edge 158. Although the rear bottom edge 158 is illustrated as substantially linear in the illustrated embodiments, it is contemplated that the rear bottom edge can be non-linear in some embodiments. The rear surface 170 can extend between the rear bottom edge 158, the outer rear edge 152, the inner rear edge 154, and the rear top edge 156, forming a substantially trapezoidal surface in some embodiments.

Figure 12:
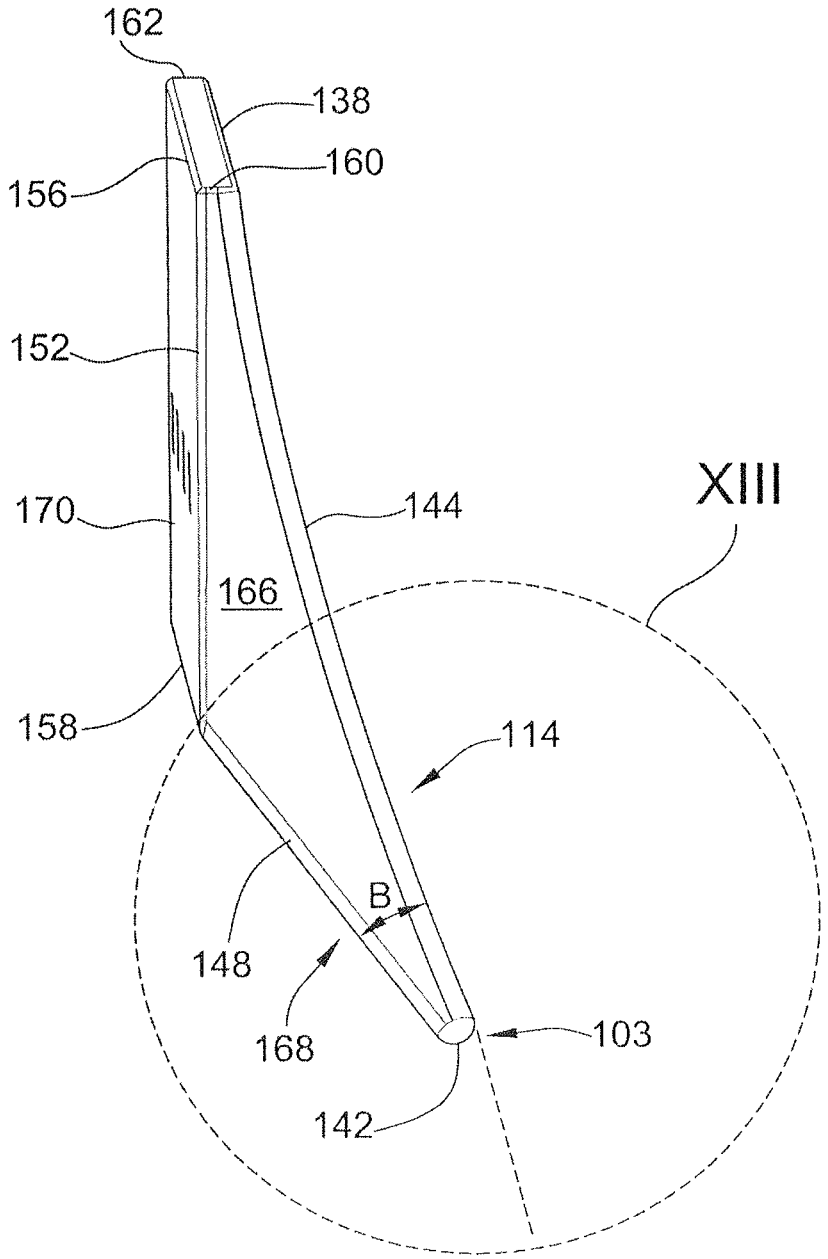
FIG. 12 is a rear-side perspective view of the implement end cutting-bit of FIG. 3.
Figure 13:
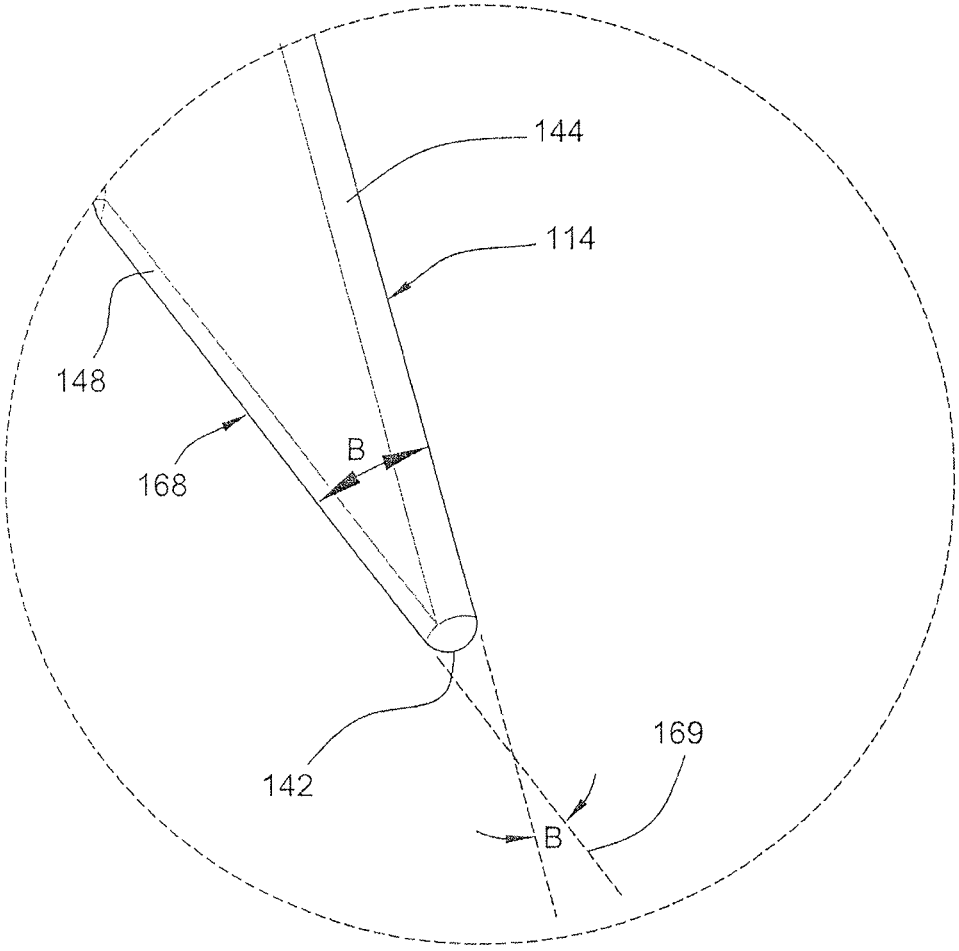
FIG. 13 is an enlarged, detail view taken from FIG. 12 as indicated by circle XIII.

The bottom surface 168 can intersect the contoured upper front surface 114 along the bottom interface 120 at the spearhead edge 142. FIG. 12 illustrates the intersection of the contoured upper front surface 114 and the bottom surface 168 along the spearhead edge 142. At least a portion of bottom surface 168 can define a bottom surface plane 169, as illustrated in FIG. 13. The intersection of the contoured upper front surface and the bottom surface plane 169 can define a spearhead edge angle B measured about the spearhead edge 142. The spearhead edge angle B can represent the angle formed between the contoured upper front surface 114 and the bottom surface 168 with respect to any point along the spearhead edge 142. Although FIG. 13 show the spearhead edge angle B measured at the outer spearhead corner 143, due to the concavity of the contoured upper front surface 114, the spearhead edge angle B can be variable along the spearhead edge 142. In some embodiments, the spearhead edge angle B can be less than about 90 degrees. In other embodiments, the spearhead edge angle B can be less than about 60 degrees. In other embodiments, the spearhead edge angle B can be in a range between about 10 degrees and about 55 degrees. In yet other embodiments, the spearhead edge angle B can be in a range between about 30 degrees and about 50 degrees. The nature of the spearhead edge angle B can allow for the end cutting-bit 100 to more effectively and efficiently cut through a working material as the machine 50 makes a pass in a work area. In embodiments in which the spearhead edge angle B is less than 90 degrees, a relief area can be formed behind the portion of the contoured upper front surface 114 adjacent the bottom surface 168 as the end cutting-bit 100 passes through the work material. Debris cut from the surface of the work material can then be allowed to pass under the spearhead edge 142 or around the outer side surface 166 adjacent the contoured upper front surface 114 of the body 101 and into the relief area, increasing cutting efficiency. The cutting efficiency of the end cutting-bit 100 can also be affected by the angle formed between the contoured upper front surface 114 and the working surface.

Figure 7:
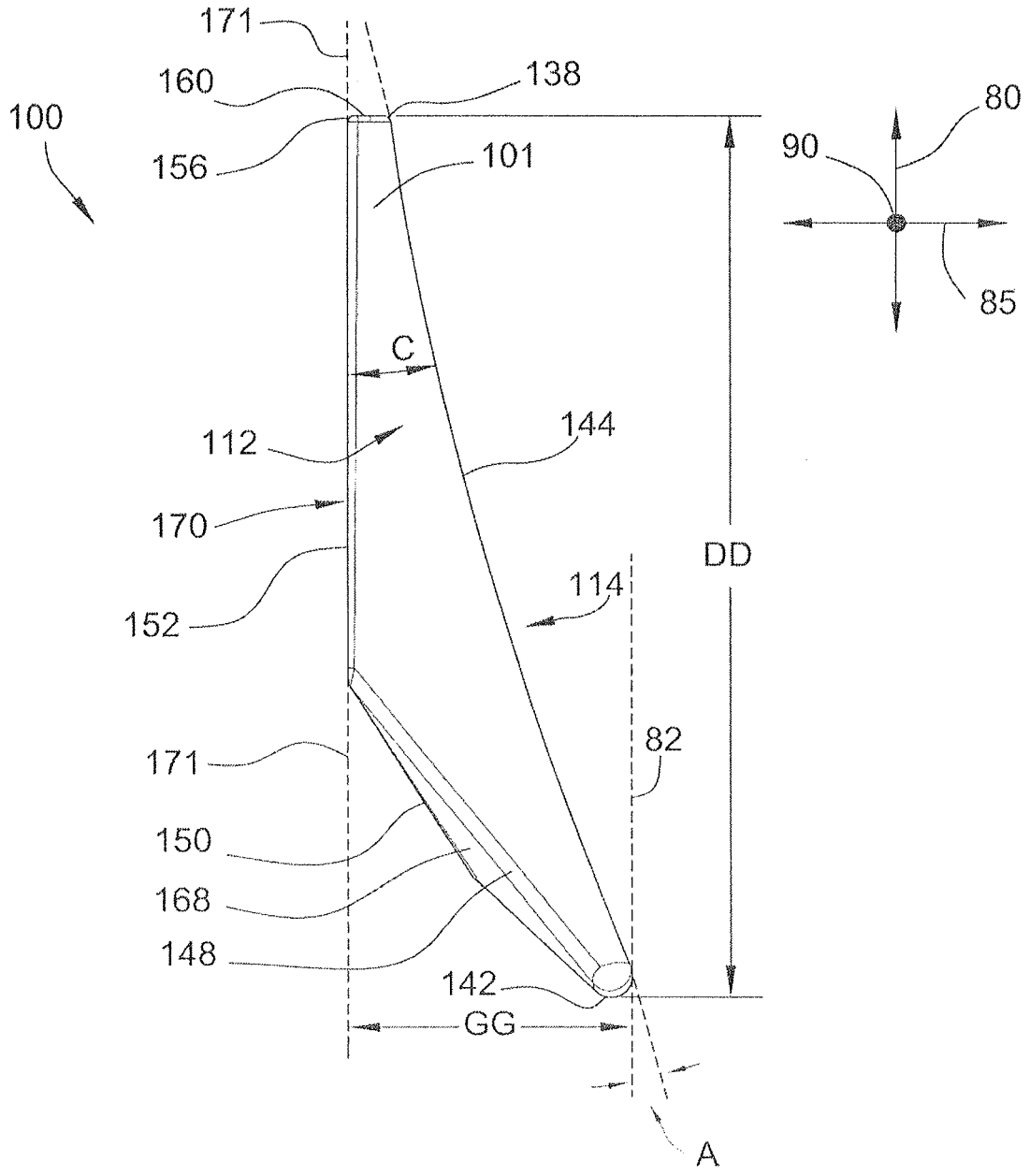
FIG. 7 is a right side elevation view of the implement end cutting-bit of FIG. 3.

Referring now to FIG. 7, the body 101 of the end cutting-bit 100 can be aligned such that the outer top edge 160 extends substantially along the longitudinal axis 85, and the top edge 138 extends along the lateral axis 90. In such an alignment, a contoured upper front surface angle C can be formed between the contoured upper front surface 114 and a normal-lateral plane 82, which is the plane defined by the normal axis 80 and the lateral axis 90. In the embodiment illustrated in FIG. 7, the rear surface 170 can define a rear surface plane 171 parallel to the normal-lateral plane 82. Although FIG. 7 shows the contoured upper front surface angle C measured at the outer top edge 160, due to the concavity of the contoured upper front surface 114, the contoured upper front surface angle C can be variable along the top edge 138. In some embodiments, the contoured upper front surface angle C can be less than about 30 degrees. In other embodiments, the contoured upper front surface angle C can be less than about 20 degrees. In some embodiments, the contoured upper front surface angle C can be in a range between about 5 degrees and about 30 degrees. In yet other embodiments, the contoured upper front surface angle C can be in a range between about 10 degrees to about 20 degrees. In some embodiments, the contoured upper front surface angle C can be in a range between about 0 degrees and about 25 degrees. In embodiments where the contoured upper surface angle C is substantially 0 degrees, at least portions of the contoured upper front surface 114 can be substantially parallel to the rear surface 170, particularly adjacent the outer side edge 144.

As also shown in FIG. 7, a spearhead vertical angle A can be formed between the normal-lateral plane 82 and the surface of the contoured upper front surface 114 adjacent the spearhead edge 142. In FIG. 7, the normal-lateral plane 82 is aligned along the normal axis 80. In some embodiments, the spearhead vertical angle A can be in a range between about 0 degrees and about 30 degrees, and in a range between about 10 degrees and about 25 degrees in other embodiments. In some embodiments, the spearhead vertical angle A can be in a range between about 12 degrees and about 20 degrees, and between about 20 degrees and about 25 degrees in other embodiments. In some embodiments, the spearhead vertical angle A can be determined generally as a function of the body depth GG, discussed in more detail below.

Figure 8:
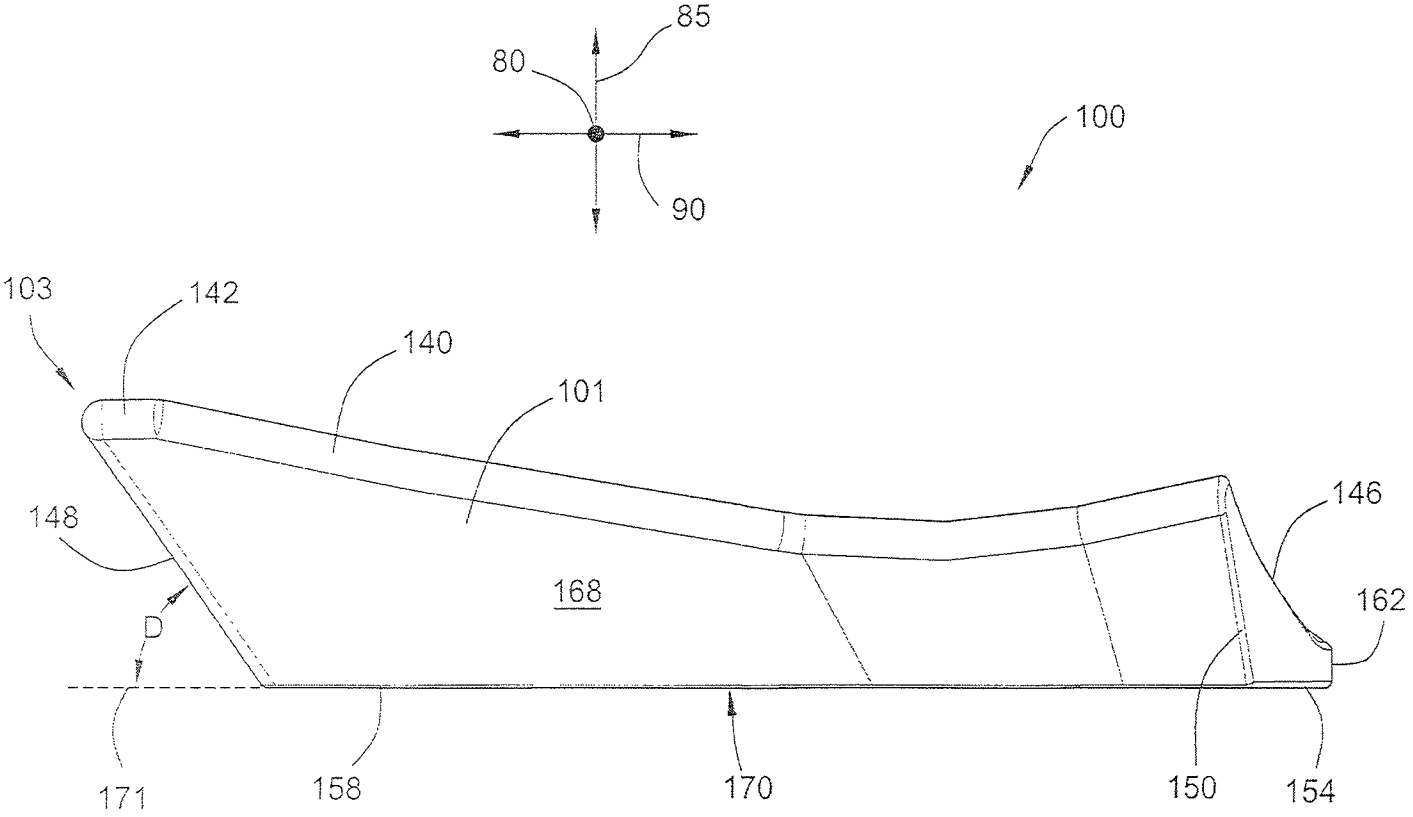
FIG. 8 is a bottom view of the implement end cutting-bit of FIG. 3.
Figure 9:
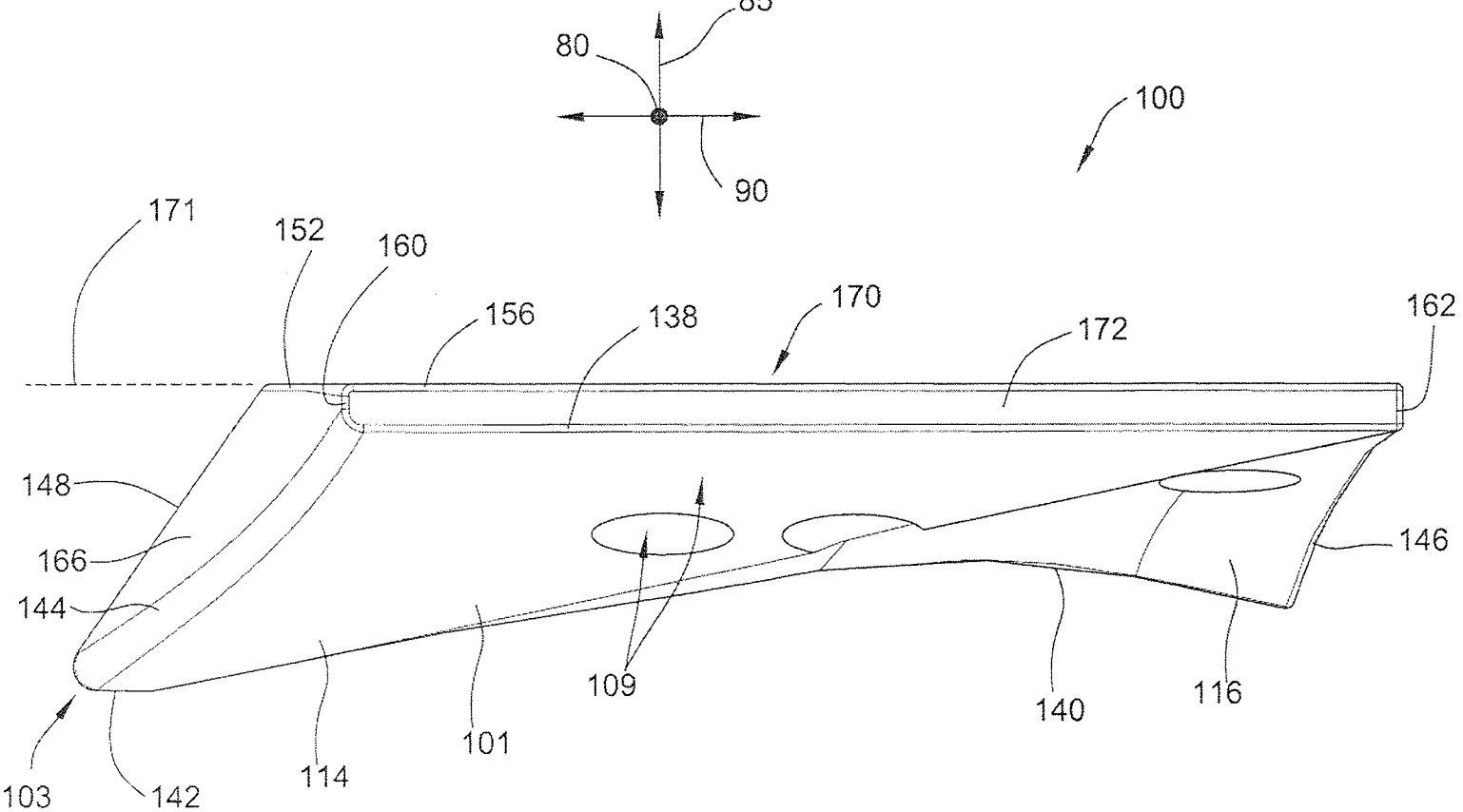
FIG. 9 is a top plan view of the implement end cutting-bit of FIG. 3.

Referring now to FIG. 8, the illustrated embodiment of the body 101 of the end cutting-bit 100 is shown with the rear bottom edge 158 extending substantially along the lateral axis 90, the inner top edge 162 extending substantially along the longitudinal axis 85, and the inner rear edge 154 extending substantially along the normal axis 80. In such an alignment, an outer bottom edge angle D is formed between the rear surface plane 171 and the outer bottom edge 148 in a plane defined by the longitudinal axis 85 and the lateral axis 90. The outer bottom edge angle D is also illustrated in FIG. 9. In some embodiments, the outer bottom edge angle D can be less than about 90 degrees, and less than about 70 degrees in other embodiments. In some embodiments, the outer bottom edge angle D can be in a range between about 35 degrees and about 75 degrees, and between about 50 degrees and about 75 degrees in other embodiments. In yet other embodiments, the outer bottom angle D can be in a range between about 60 degrees and about 70 degrees. The nature of the outer bottom edge angle D can allow for the end cutting-bit 100 to more effectively and efficiently cut through a working material as the machine 50 makes a pass in a work area. In embodiments in which the outer bottom edge angle D is less than 90 degrees, a relief area can formed behind the portion of the contoured upper front surface 114 adjacent the outer side surface 166 as the end cutting-bit 100 passes through the work material. Debris cut from the surface of the work material can then be allowed to pass around the contoured upper front surface 114 of the body 101 and into the relief area, increasing cutting efficiency.

FIG. 9 also illustrates a top surface 172, which can be adjacent the contoured upper front surface 114 along the top edge 138 and adjacent the rear surface 170 along the rear top edge 156. The top surface 172 can also extend between top edge 138, the rear top edge 156, the outer top edge 160, and the inner top edge 162. In some embodiments, the top surface 172 can be a flat surface formed on the body 101 in a lateral-longitudinal plane 87, which is the plane defined by the lateral axis 90 and the longitudinal axis 85. It is contemplated, however, that the top surface 172 can have a non-flat shape in other embodiments.

Figure 10:
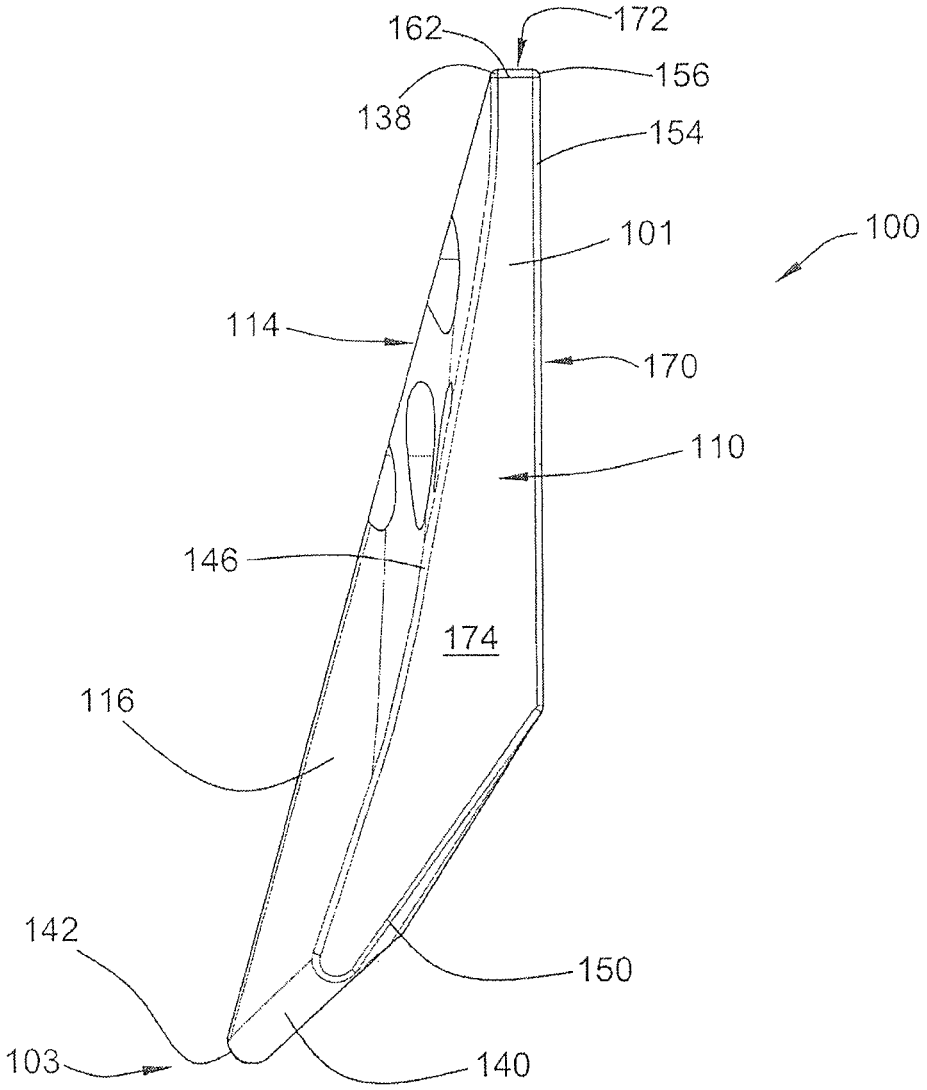
FIG. 10 is left side elevation view of the implement end cutting-bit of FIG. 3.

Referring now to FIG. 10, an inner side surface 174 can be formed on the inner side portion 110 of the body 101. The inner side surface 174 can be disposed adjacent the contoured lower front surface 116 along the inner side edge 146. The inner side surface 174 can extend between the inner side edge 146, the inner top edge 162, the inner rear edge 154, and the inner bottom edge 150. In the illustrated embodiment, the inner side surface 174 can be substantially flat with a substantially trapezoidal shape; however, it is contemplated that the inner side surface can be non-flat and non-trapezoidal in other embodiments. As illustrated in FIG. 2, in some embodiments, the inner side surface 174 can abut or nearly abut against an adjacent intermediate cutting-edge 70 or other wear member when the end cutting-bit 100 is mounted to a blade or other implement.

The figures and drawings disclosed herein illustrate various features of an embodiment of the end cutting-bit 100 having relative lengths and angle measurements. It should be understood, however, that the dimensions disclosed are not exhaustive and other suitable dimensions are contemplated.

Figure 6:
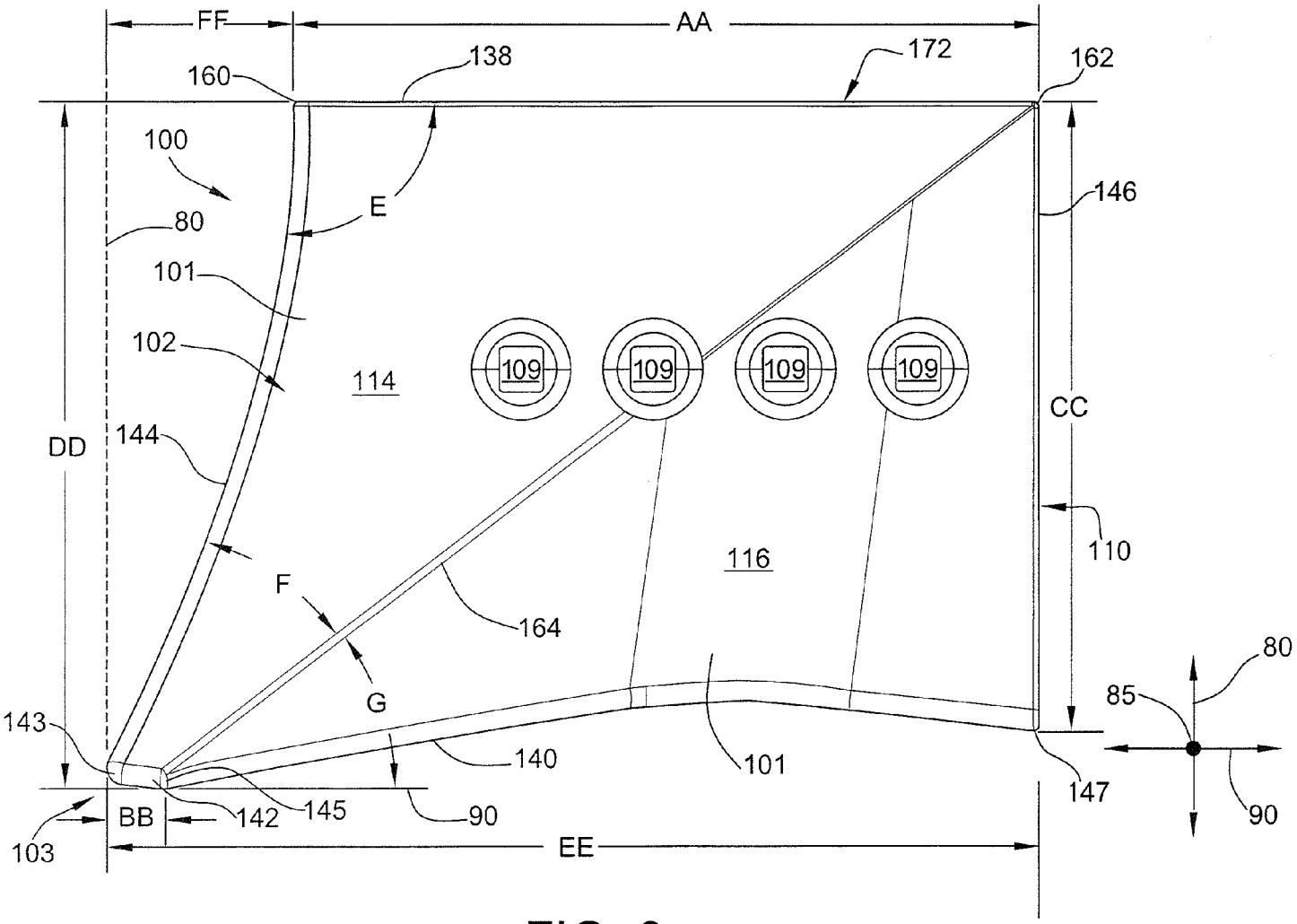
FIG. 6 is a front view of the implement end cutting-bit of FIG. 3.

FIG. 6 illustrates the body 101 of the end cutting-bit 100 aligned such that the top edge 138 extends substantially along the lateral axis 90 and the inner top edge 162 extends substantially along the longitudinal axis 85. In such an alignment, an outer side edge angle E can be formed between the outer side edge 144 and the top edge 138 in a normal-lateral plane, which is a the plane defined by the normal axis 80 and the lateral axis 90. In some embodiments, the outer side angle E can be at least 90 degrees. In other embodiments, the outer side angle E can be at least 100 degrees. In some embodiments, the outer side angle E can be in a range between about 90 degrees and about 120 degrees. In yet other embodiments, the outer side angle E can be in a range between about 90 degrees and about 100 degrees. Alternatively, outer side angle E can be as low as about 45 degrees.

FIG. 6 also illustrates a spearhead surface angle F formed between the outer side edge 144 and the ridge 164 in the normal-lateral plane. In some embodiments, the spearhead surface angle F can be at most 55 degrees, and can be at most 45 degrees in other embodiments. In other embodiments, the spearhead surface angle F can be in a range between about 20 degrees and about 50 degrees. In yet other embodiments, the spearhead surface angle F can be in a range between about 30 degrees and about 40 degrees.

A ridge angle G can be formed in the normal-lateral plane between the ridge 164 and the lateral axis 90 when the body 101 is aligned such that the top edge 138 extends substantially along the lateral axis and the inner top edge 162 extends substantially along the longitudinal axis 85. In some embodiments, the ridge angle G can be less than about 50 degrees, and can be less than about 45 degrees in other embodiments. In some embodiments, the ridge angle G can be in a range between about 20 degrees and about 45 degrees. In yet other embodiments, the ridge angle G can be in a range between about 30 degrees and about 40 degrees.

As illustrated in FIG. 6, the top edge 138 can extend substantially along the lateral axis 90 with a top edge length AA defined as the distance along the lateral axis between the outer top edge 160 and the inner top edge 162. The spearhead edge 142 can have a spearhead edge length BB defined as the distance along the lateral axis 90 between the inner spearhead corner 145 and the outer spearhead corner 143. In some embodiments, a ratio between the spearhead edge length BB and the top edge length AA can be less than about 1:5. In other embodiments, a ratio between the spearhead edge length BB and the top edge length AA can be less than about 1:10. In some embodiments, a ratio of the spearhead edge length BB to the top edge length AA can be in a range between about 1:10 and about 1:20. In other embodiments, a ratio of the spearhead edge length BB to the top edge length AA can be in a range between about 1:10 and about 1:15. In other embodiments, a ratio of the spearhead edge length BB to the top edge length AA can be in a range between about 1:11 and about 1:13.

The body 101 can have an inner side height CC measured as the distance along the normal axis 80 between the inner top edge 162 and the inner side corner 147. The body 101 can also have an outer side height DD measured as the distance along the normal axis 80 between the outer top edge 160 and the outer spearhead corner 143. In some embodiments, a ratio of the inner side height CC to the outer side height DD can be less than about 1:1. In some embodiments, a ratio of the inner side height CC to the outer side height DD can be in a range from about 3:4 to about 1:1. In other embodiments, a ratio of the inner side height CC to the outer side height DD can be in a range from about 9:10 to about 1:1. In some embodiments, a ratio of the inner side height CC to the outer side height DD can be about 5:6. In some embodiments, a ratio of the outer side height DD to the top edge length AA can be less than about 3:2. In other embodiments, a ratio of the outer side height DD to the top edge length AA can be less than about 1:1. In yet other embodiments, a ratio of the outer side height DD to the top edge length AA can be less than about 9:10. In some embodiments, a ratio of the outer side height DD to the top edge length AA can be in a range between about 1:2 and about 3:2. In other embodiments, a ratio of the outer side height DD to the top edge length AA can be in a range between about 3:4 and about 1:1. In yet other embodiments, a ratio of the outer side height DD to the top edge length AA can be in a range between about 17:20 and about 19:20.

The body can have a bottom length EE measured as the distance along the lateral axis 90 between the outer spearhead corner 143 and the inner side corner 147. In some embodiments, a ratio of the top edge length AA to the bottom length EE can be less than about 3:2. In other embodiments, a ratio of the top edge length AA to the bottom length EE can be less than about 1:1. In yet other embodiments, a ratio of the top edge length AA to the bottom length EE can be less than about 9:10. In some embodiments, a ratio of the top edge length AA to the bottom length EE can be in a range between about 1:2 and about 3:2. In other embodiments, a ratio of the top edge length AA to the bottom length EE can be in a range between about 3:4 and about 1:1. In yet other embodiments, a ratio of the top edge length AA to the bottom length EE can be in a range between about 4:5 and about 9:10. In some embodiments, a ratio between the spearhead edge length BB and the bottom length EE can be in a range between about 0:20 and about 1:20, and in a range between about 0:4 and about 1:4 in other embodiments. In some embodiments, a ratio between the spearhead edge length BB and the bottom length EE can be in a range between about 1:20 and about 1:4, and in a range between about 1:10 and about 1:4 in other embodiments. In some embodiments, a ratio between the spearhead edge length BB and the bottom length EE can be about 1:20, and can be about 1:5 in other embodiments. It is also contemplated that, in some embodiments, the spearhead edge length BB can be substantially zero. In such embodiments, the ridge 164 and the outer side edge 144 can intersect to form a point at the outer spearhead corner 143.

The body 101 can also have a spearhead offset length FF measured as the distance along the lateral axis 90 between the outer top edge 160 and the outer spearhead corner 143. In some embodiments, a ratio of the spearhead offset length FF to the top edge length AA can be less than about 1:2, and can be about 0:2 in other embodiments. In other embodiments, a ratio of the spearhead offset length FF to the top edge length AA can be less than about 1:3. In some embodiments, a ratio of the spearhead offset length FF to the top edge length AA can be in a range between about 1:10 and about 1:2. In other embodiments, a ratio of the spearhead offset length FF to the top edge length AA can be in a range between about 1:8 and about 3:8. In yet another embodiment, a ratio of the spearhead offset length FF to the top edge length AA can be in a range between about 1:5 and about 1:3. In some embodiments, a ratio between the spearhead offset length FF and the bottom length EE can be in a range between about 0:4 and about 1:4. In some embodiments, the bottom length EE can be substantially equal to the sum of the spearhead offset length FF and the top edge length AA. It is also contemplated that, in some embodiments, the top edge length AA can be substantially equal to the bottom length EE, and the spearhead offset length FF can be substantially zero.

Referring now to FIG. 7, the body 101 can have a body depth GG measured as the distance along the longitudinal axis 85 between the spearhead edge 142 and the rear surface 170. In some embodiments, a ratio of the body depth GG to the outer side height DD can be less than about 1:1. In other embodiments, a ratio of the body depth GG to the outer side height DD can be less than about 1:2. In yet other embodiments, a ratio between the body depth GG and the outer side height DD can be less than about 1:3. In some embodiments, a ratio of the body depth GG to the outer side height DD can be in a range between about 1:10 and about 1:1. In other embodiments, a ratio between the body depth GG and the outer side height DD can be in a range between about 1:4 and about 1:2. In yet other embodiments, a ratio of the body depth GG to the outer side height DD can be in a range between about 2:5 and about 1:2. In other embodiments, a ratio of the body depth GG to the outer side height DD can be about 2:5.

The specific body depth GG of the end cutting-bit 100 described herein and its relationship with other listed geometric dimensions can provide for improved end cutting-bit performance. For example, when mounted to an earth-working implement, the body depth GG described can provide that the spearhead edge 142 juts forward so as to allow for improved attack angles into the work surface. This improved performance is particularly evident when the end cutting-bit 100 is mounted to an earth-working implement having a substantially flat face, as the body depth GG and the other described geometric features of the end cutting-bit can have the effect of making a flat implement act more like a U-shaped implement. The geometric dimensions and ratios that follow from the body depth GG as described herein are particularly effective at striking a favorable balance between applying a cutting force along the plane of a work surface, and applying a digging force along a plane perpendicular to a work surface.

Figure 14:
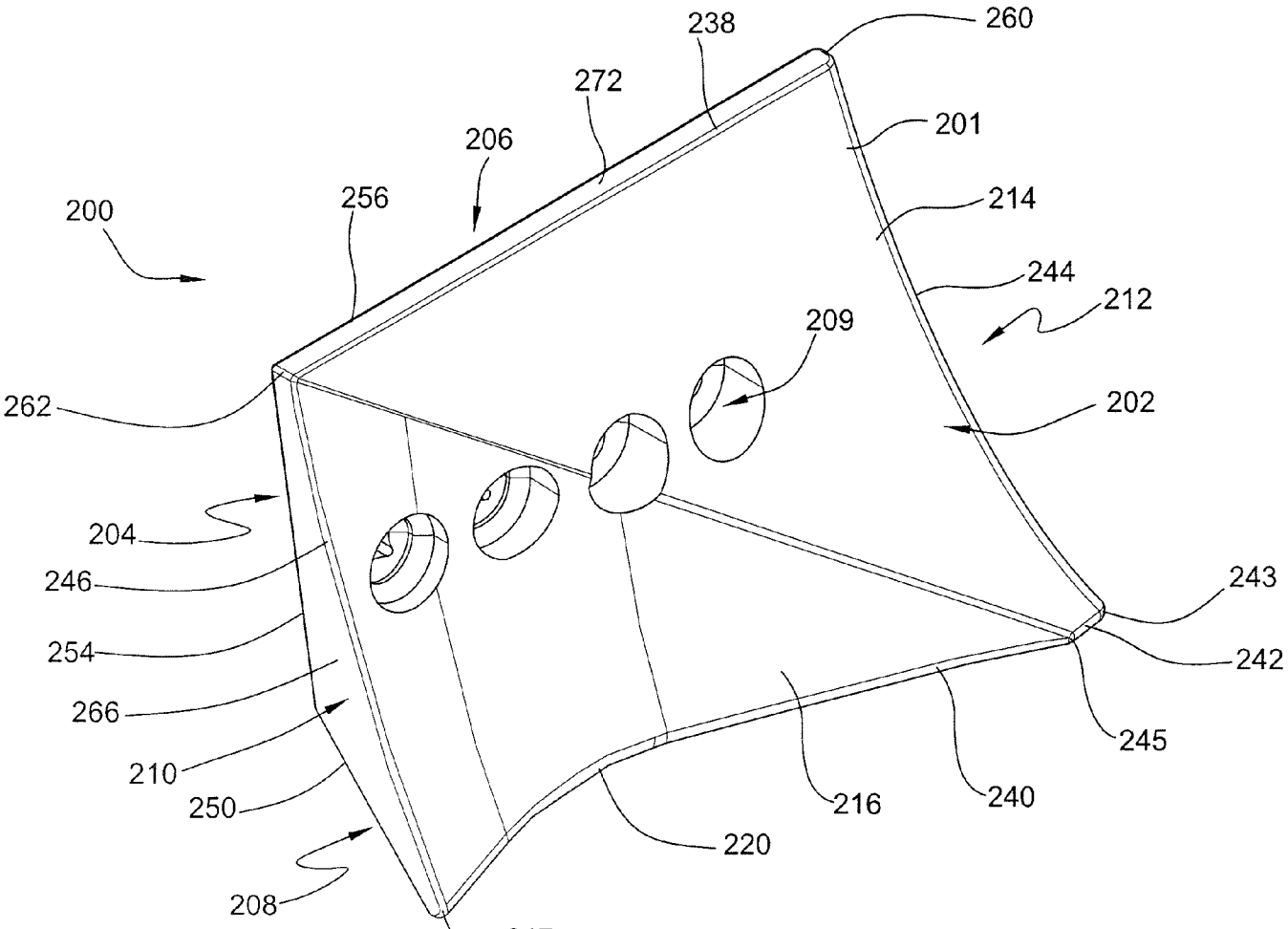
FIG. 14 is a front-right perspective view of another embodiment of an implement end cutting-bit constructed in accordance with the principles of the present disclosure.
Figure 15:
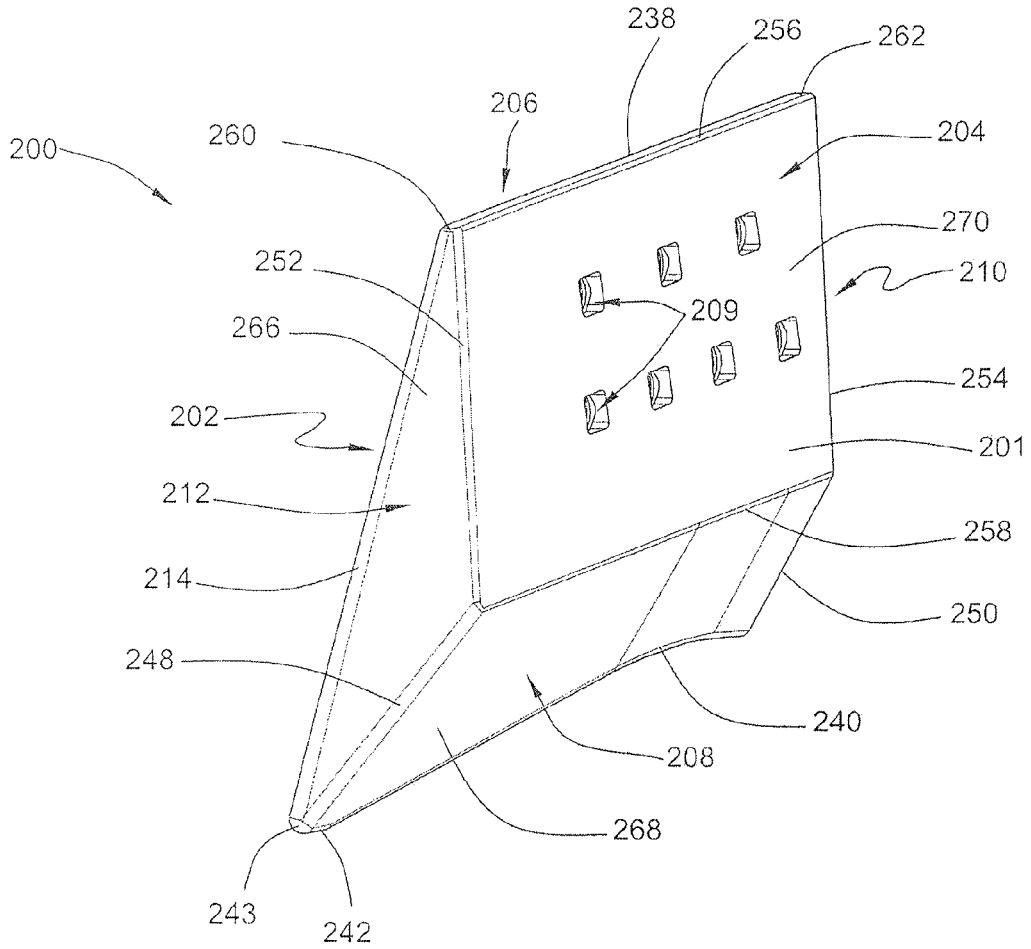
FIG. 15 is a rear-left perspective view of the implement end cutting-bit of FIG. 14.

FIGS. 14 and 15 illustrate an embodiment of the end cutting-bit 200 that can be adapted to be mounted to the earth-working blade 66 at the second blade end 74 of the mounting edge 68. The end cutting-bit 200 can be substantially symmetrical to the end cutting-bit 100 in some embodiments. The end cutting-bit 200 can have a body 201 with a front portion 202 and a rear portion 204 formed on the body. The body 201 can also have a top portion 206, a bottom portion 208, an outer side portion 212, and an inner side portion 210 substantially similar to the corresponding portions of the end cutting-bit 100. Other like-numbered features of the end cutting-bit 200 illustrated in the figures can have similar features to the end cutting-bit 100.

Figure 16:
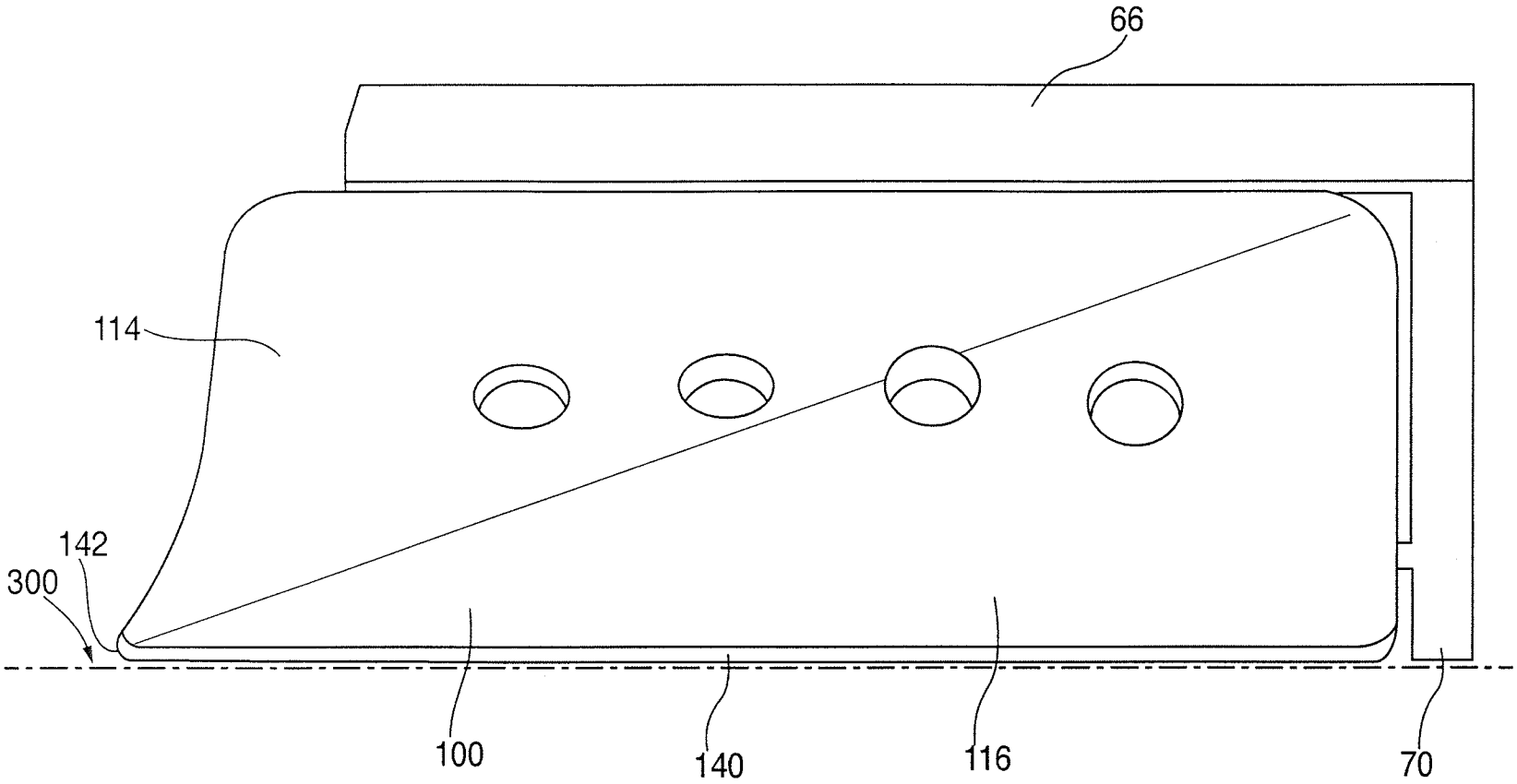
FIG. 16 is a partial front view of the implement end cutting-bit of FIG. 3 mounted to the implement of FIG. 2.
Figure 17:
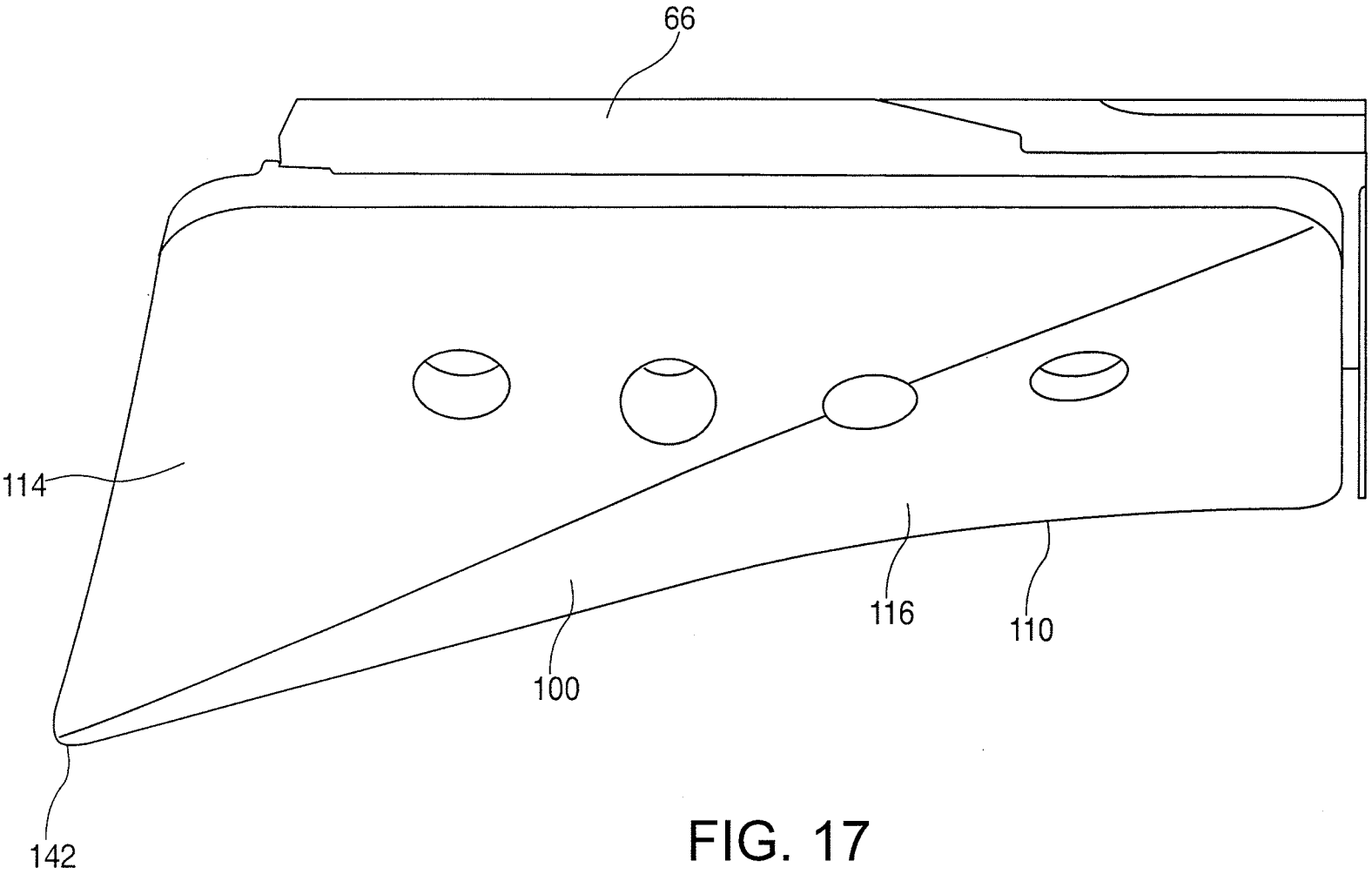
FIG. 17 is a partial top view of the implement end cutting-bit of FIG. 3 mounted to the implement of FIG. 2.
Figure 18:
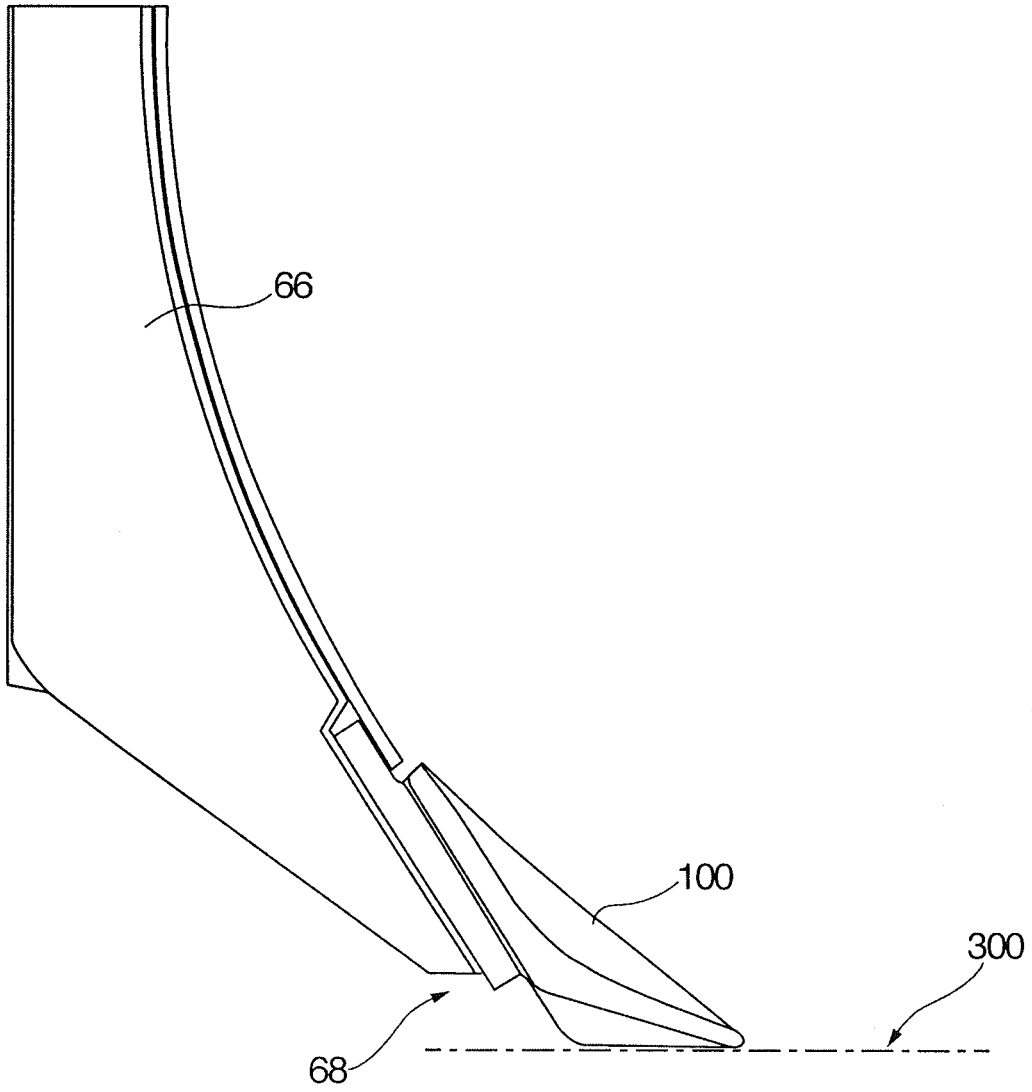
FIG. 18 is a partial right side elevation view of the implement end cutting-bit of FIG. 3 mounted to the implement of FIG. 2.
Figure 19:
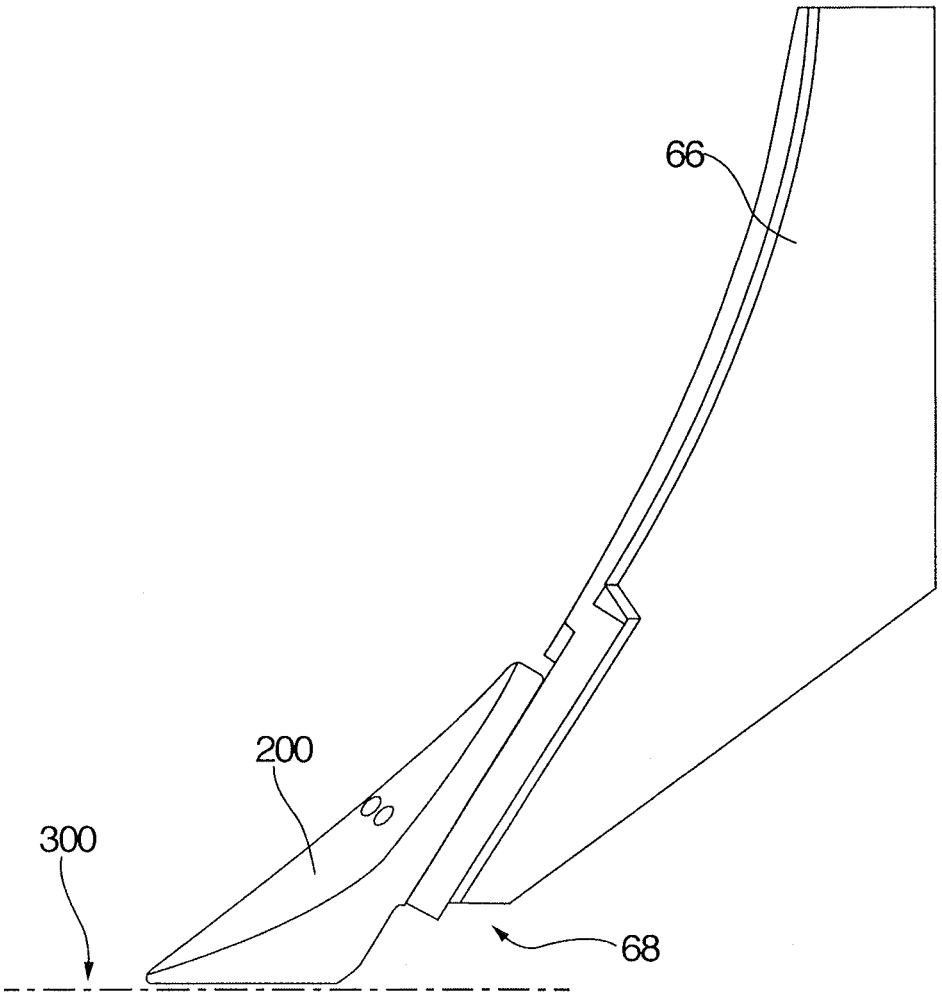
FIG. 19 is a partial left side elevation view of the implement end cutting-bit of FIG. 14 mounted to the implement of FIG. 2.
Figure 20:
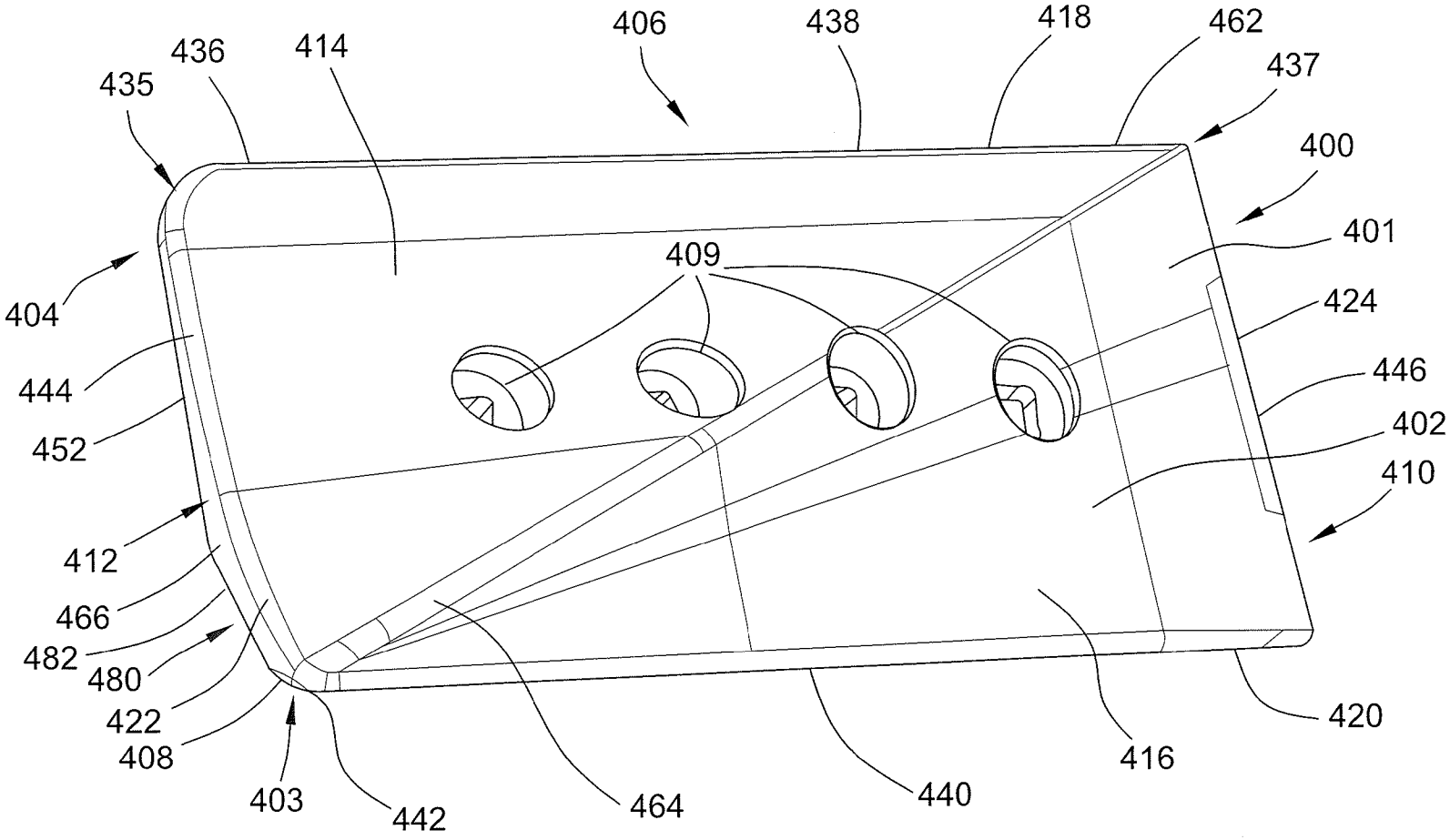
FIG. 20 a front-right perspective view of another embodiment of an implement end cutting-bit constructed in accordance with the principles of the present disclosure.

Referring to FIGS. 16 and 17, the end cutting-bit 100 is shown mounted to the mounting edge 68 of an implement blade 66 adjacent an intermediate cutting-edge 70. FIG. 16 shows a perspective of the front face of the end cutting-bit 100 as viewed substantially parallel to a working surface 300. When view from this perspective, it is shown that, though the cutting edge 140 has a substantially curved shape, the cutting edge can be applied parallel and flush with respect to the working surface 300 when mounted to the blade 66. Such a mounting configuration can help maximize the effects of the end cutting-bit geometries described herein. FIG. 17 illustrates a top view of the end cutting-bit 100 as shown in FIG. 16 mounted to an implement blade 66. FIG. 18 shows side view of the end cutting-bit 100 mounted to the mounting edge 68 of one end of the implement blade 66 in a similar mounting configuration as in FIGS. 16 and 17. FIG. 19 shows the end cutting-bit 200, such as that illustrated in FIGS. 14 and 15, mounted to the mounting edge 68 of the implement blade 66.

FIGS. 20-23 illustrate a further embodiment of an end cutting-bit 400 that can be adapted to be mounted to the earth-working blade 66 at the first blade end 72 of the mounting edge 68 (FIG. 2). It will be understood that the end cutting-bit 400 can be constructed to mount at the second blade end 74 by forming it as a mirror image.

The end cutting-bit 400 can be substantially similar in form to the end cutting-bit 100 in some embodiments. For example, the end cutting-bit 400 can have a body 401 with a front portion 402 and a rear portion 404 formed on the body. The body 401 can also have a top portion 406, a bottom portion 408, an outer side portion 412, and an inner side portion 410 substantially similar to the corresponding portions of the end cutting-bit 100. Other like-numbered features of the end cutting-bit 400 illustrated in the figures can have similar features to the end cutting-bit 100.

Interfaces can exist between each of the adjacent portions. Specifically, a top interface 418 can exist between the top portion 406 and the front portion 402, and a bottom interface 420 can exist between the front portion 402 and the bottom portion 408. An outer side interface 422 can exist between the front portion 402 and the outer side portion 412. An inner side interface 424 can exist between the front portion 402 and the inner side portion 410. Additionally, an outer rear interface 430 can exist between the outer side portion 412 and the rear portion 404, and an inner rear interface 432 can exist between the inner side portion 410 and the rear portion 404. A rear bottom interface 434 can exist between the rear portion 404 and the bottom portion 408, and a rear top interface 436 can exist between the top portion 406 and the rear portion. Finally, in some embodiments, an outer top interface 435 can exist between the outer side portion 412 and the top portion 406, and an inner top interface 437 can exist between the inner side portion 410 and the top portion.

In some embodiments, a plurality of mounting holes 409 can be formed in the body 401, creating passages between the front portion 402 and the rear portion 404 of the body. The mounting holes 409 can be adapted to receive mounting hardware, such as bolts, screws, rivets, or other mounting tools suitable to secure the end cutting-bit 400 to an implement. In some embodiments, the mounting holes 409 can be countersunk to provide a smooth, flush surface on the front portion 402. While some of the illustrated embodiments show seven mounting holes 409 adapted to receive seven sets of mounting hardware, it is contemplated that any number of mounting holes can be used in other embodiments, for example four mounting holes.

Each interface on the body 401 can define one or more edges that can define surfaces on the body. Specifically, a top edge 438 can be disposed along the top interface 418, and a cutting edge 440 can be disposed along at least a portion of the bottom interface 420 and extend between the inner side portion 410 and the spearhead protrusion 403. In some embodiments, the cutting edge 440 can curve concavely away from the front portion 402, defining an edge that curves away from the spearhead protrusion 403. A spearhead edge 442 can also be disposed along the bottom interface 420 and extend between the outer side portion 412 and the cutting edge 440, which can form the forward edge of the spearhead protrusion 403. An outer side edge 444 can be disposed along the outer side interface 422 between the top edge 438 and the spearhead edge 442. The outer side edge 444 can have a concave curvature in certain embodiments. Additionally, the body 401 can include an outer bottom edge 448 disposed along the outer bottom interface 426 and extending between the spearhead edge 442 and the rear portion 404. An outer rear edge 452 can be disposed along the outer rear interface 430 and extend between the top portion 406 and the outer bottom edge 448, and an inner rear edge 454 can be disposed along the inner rear interface 432. A rear bottom edge 458 can be disposed along the rear bottom interface 434 and extend between the outer rear edge and the inner rear edge. Further, in some embodiments, an outer top edge 460 can be defined along the outer top interface 435 and inner top edge 462 can be defined along the inner top interface 437 and extend between the top edge and the rear top edge. In the illustrated embodiments, the various edges can be rounded or chamfered to form rounded edges and corners to the body 401. It is contemplated, however, that the edges of the body 401 can have sharp corners, angled bevels, or any other suitable shape.

The front portion 402 of the body 401 can define a contoured upper front surface 414 and a contoured lower front surface 416. A ridge 464 can also be disposed on the front portion 402 separating the contoured upper front surface 414 from the contoured lower front surface 416. In some embodiments, the ridge 464 can extend along the front portion 402 between the inner top edge 462 and the spearhead edge 442. The contoured upper front surface 414 can form a generally trapezoidal concave depression on the front portion 402 of the body 401 that extends between the top edge 438, the outer side edge 444, the ridge 464, and the spearhead edge 442. In some embodiments, the contoured upper front surface 414 can have a curvature consistent across the contoured upper front surface. In other embodiments, the curvature of the contoured upper front surface can vary at different points along the surface. In some embodiments, the curvature of the contoured upper front surface 414 varies across the surface and can dictated by the geometry of the ridge 464, the outer side edge 444, the top edge 438, and the spearhead edge 442. It is also contemplated that, in some embodiments, the spearhead edge 442 can simply be a point and, in such embodiments, the contoured upper front surface 414 can have a generally triangular shape.

The contoured lower front surface 416 can form a generally triangular concave depression on the front portion 402 of the body 401 adjacent the contoured upper front surface 414. The generally concave shape of the contoured upper and lower front surfaces 414, 416 can help in directing work material debris away from the spearhead protrusion 403 as the end cutting-bit 400 passes through the work material. This can reduce work material build-up at the point of the end cutting-bit 400 that engages the work material, which can improve cutting and clearing efficiency. It is contemplated, however, that the contoured lower front surface 416 can have other shapes in other embodiments. The contoured lower front surface 416 can extend between the ridge 464, the inner side edge 446, and the cutting edge 440. The shape and curvature of the contoured lower front surface 416 and the cutting edge 440 can vary in different embodiments of the end cutting-bit 400 depending on the dimensions of the particular intermediate cutting-edge used to ensure a smooth transition between the adjacent wear members mounted on an earth-working implement.

An outer side surface 466 can be defined on the outer side portion 412 of the body 401. The outer side surface 466 can be disposed on the body 401 adjacent the contoured upper front surface 414 and extend between the outer side edge 444 and the outer bottom edge 448. In some embodiments, the outer side surface 466 can be flat; however, it is contemplated that the outer side surface can be non-flat in some embodiments, such as having a concave or convex shape.

A bottom surface 468 can be defined on the bottom portion 408 of the body 401 and a rear surface 486 can be defined on the rear portion 404 of the body. The bottom surface 468 can be disposed on the body 401 between the cutting edge 440, the spearhead edge 442, the concave rear bottom interface 484, and the inner rear interface 432. In some embodiments, the bottom surface 468 is planar. The rear surface 486 can be disposed on the rear portion 404 of the body 401. The rear bottom edge 458 can be substantially linear, however it is contemplated that the rear bottom edge can be non-linear in some embodiments.

Figure 21:
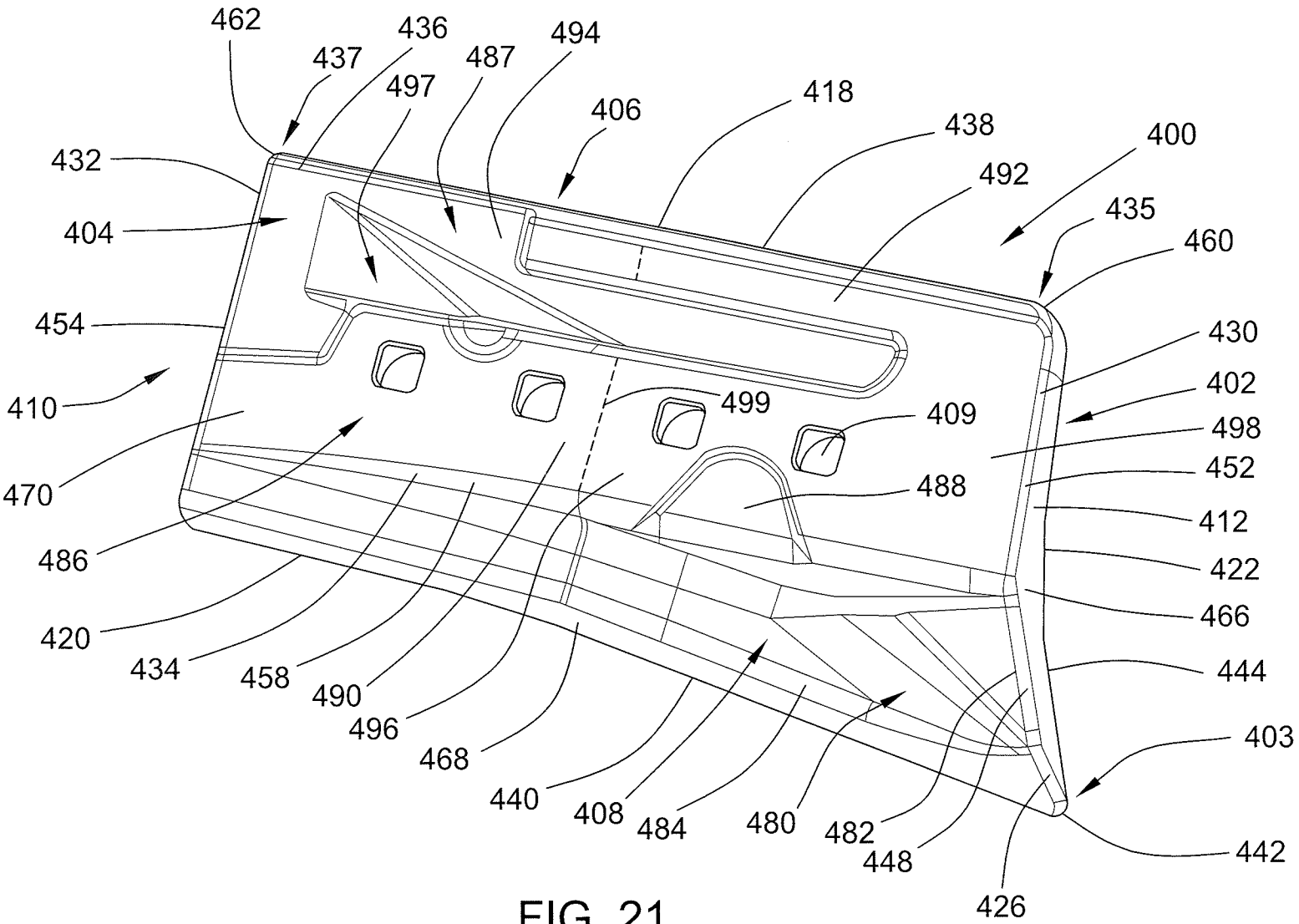
FIG. 21 is a rear-right perspective view of the implement end cutting-bit of FIG. 20.

Turning to FIG. 21, the rear portion 404 of the end cutting-bit 400 includes a rear surface 486, that instead of being entirely or substantially planar as shown in the embodiment of FIG. 5, is shaped to provide a rear mounting surface 490 that protrudes from a relieved portion 487. The rear mounting surface 490 is the part of the rear surface 486 that may abuttingly contact the mounting edge 68 of the implement blade 66 (FIG. 2) when the end cutting-bit 400 is fastened to the blade. The relieved portion 487 provides a portion of the rear surface 486 that is in a spaced apart configuration from the mounting edge 68.

In particular, the rear mounting surface 490 may be configured to provide an upper rear mounting surface 492 disposed adjacent or near the top edge 438 and a lower rear mounting surface 496 disposed adjacent or near the rear bottom interface 434. The upper rear mounting surface 492 may be completely or partially separated from the lower rear mounting surface 496 by an upper rear relieved portion 494. The lower rear mounting surface 496 may be reduced in contact area by one or more lower rear relieved portion 488.

The rear mounting surface 490 may also have an outer rear mounting surface 498 disposed approximately behind a section of the front portion 402 above the spearhead protrusion 403. The outer rear mounting surface 498 may have a first contact area. The rear mounting surface 490 may also have an inner rear mounting surface 470 approximately disposed behind a section of the front portion 402 opposite the outer rear mounting surface 498. The inner rear mounting surface 470 may have a second contact area. The second contact area is sized to be less than the first contact area such that the end cutting-bit 400 may be supported to a greater extent behind the spearhead protrusion 403 and the outer side portion 412 in an area where the end cutting-bit would be expected to experience higher stresses during use. For purposes of this disclosure, the virtual line 499 may indicate the boundary between the inner rear mounting surface 470 and the outer rear mounting surface 498.

The rear portion 404 includes a concave rear bottom surface 480 formed therein. The concave rear bottom surface 480 is formed generally between a concave rear bottom interface 484 and the rear bottom interface 434 and from about the inner rear interface 432 and the outer rear interface 430. The concave rear bottom surface 480 is formed in the bottom portion 408 to minimize weight of the end cutting-bit 400 and in effect provides an end cutting-bit with a more constant thickness without compromising the effectiveness of the part. Thus, the concave rear bottom surface 480 can generally follow the shape and contour of the adjacent front of the end cutting-bit 400, i.e., the contoured lower front surface 416. In effect, and generally speaking, the concave rear bottom surface 480 and concave rear bottom interface 484 in particular define with the contoured lower front surface 416 and cutting edge 440 the shape of the bottom surface 468. Generally, the bottom surface 468 is of a substantially constant thickness, front to back, along its side-to-side length. However, the bottom surface 468 can be of a substantially constant thickness along a majority of its front to back, along its side-to-side length, and the bottom surface can widen as it approaches the spearhead edge 442. In this embodiment, the bottom surface 468 is of a substantially constant thickness, front to back, along about 85 percent of its length. The concave rear bottom surface 480 at the concave rear bottom interface 484 cause the formation of an outer rear angled edge 482.

An upper concavity 497 can be formed in the rear portion 404 behind the contoured upper front surface 414, also with an objective of reducing the amount of material making up the end cutting-bit 400. In shape the upper concavity 497 may follow the contour of the contoured upper front surface 414 to provide a substantially uniform thickness of material in an area of the upper concavity.

Figure 22:
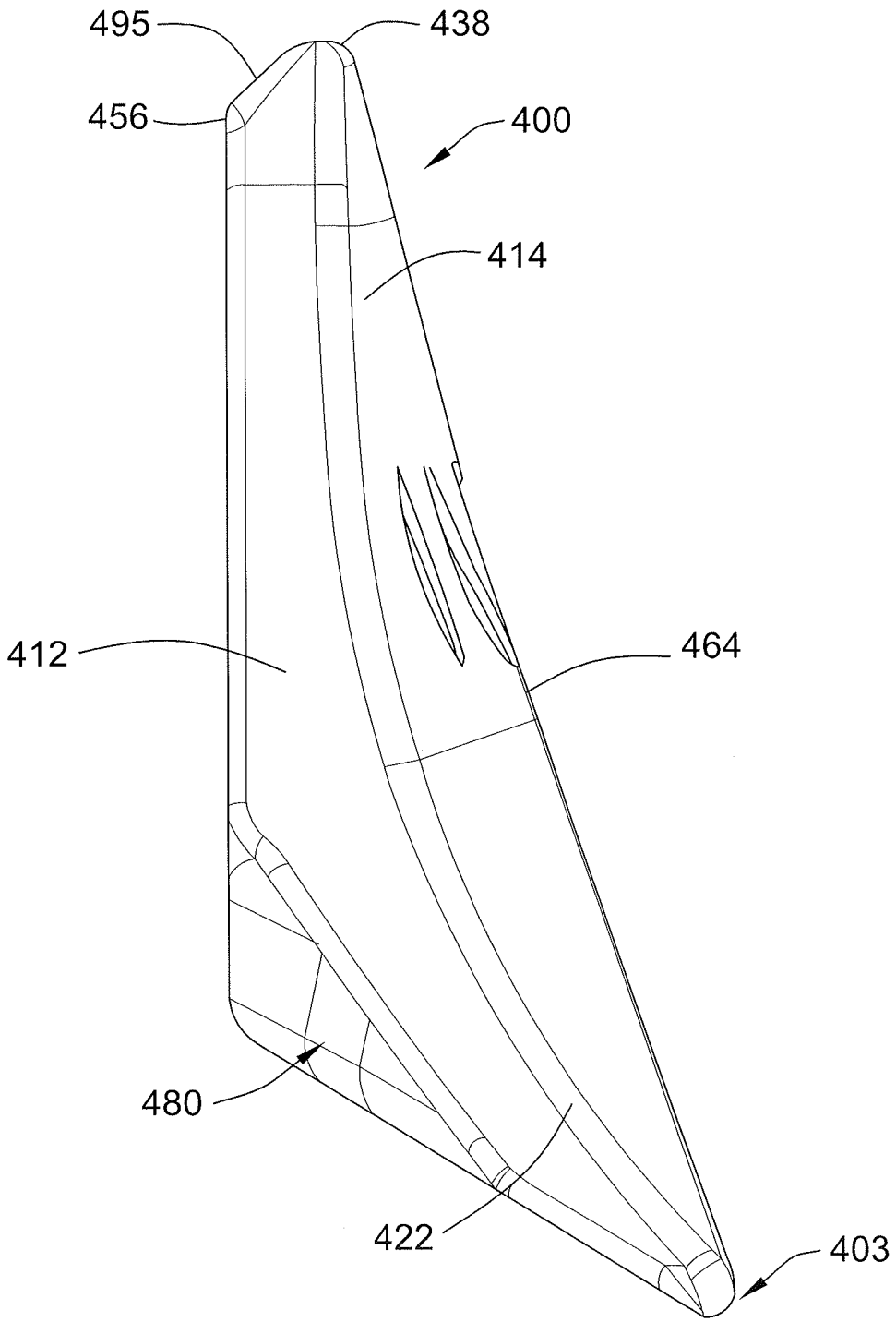
FIG. 22 is a right side elevation view of the implement end cutting-bit of FIG. 20.

FIG. 22 is a right side view of the end cutting-bit 400 showing a contoured upper front surface 414 defined between ridge 464 and outer side interface 422. The concave rear bottom surface 480 and spearhead protrusion 403 are shown as well as the outer side portion 412. The end cutting-bit 400 includes a rear top bevel 495 formed between top edge 438 and rear top edge 456. The rear top bevel 495 provides clearance to mount the end cutting-bit to the blade 66.

Figure 23:
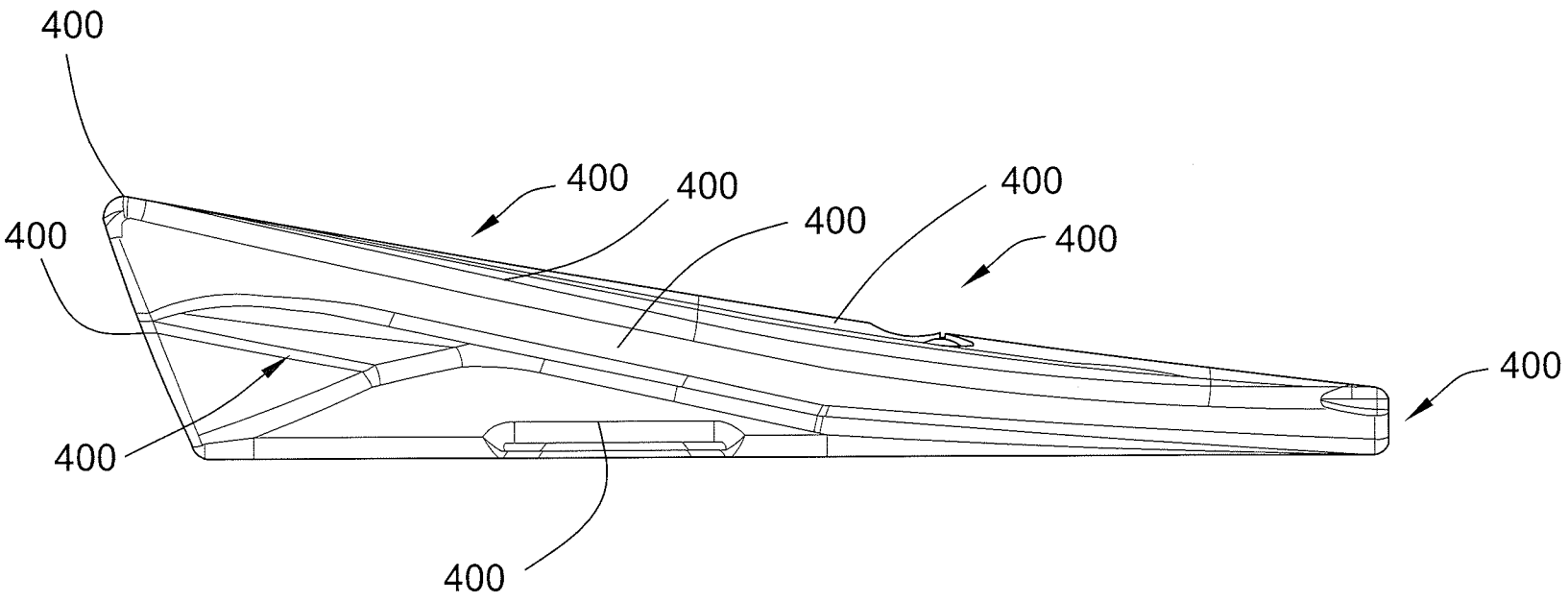
FIG. 23 is a bottom view of the implement end cutting-bit of FIG. 20.

FIG. 23 is a bottom view of the end cutting-bit 400 showing the front portion 402 and spearhead protrusion 403. The concave rear bottom surface 480 is deeper near the outer bottom edge relative to the inner side portion 410. The bottom surface 468 is defined in part by the shape of the concave rear bottom surface 480 and the cutting edge 440 at the lower part of the contoured lower front surface 416. It can be clearly seen that generally, the bottom surface 468 is of a substantially constant thickness, front to back, along its side-to-side length. However, the bottom surface 468 can be of a substantially constant thickness along a majority of its length, and furthermore the bottom surface can widen as it approaches the spearhead protrusion 403. In this embodiment, the bottom surface 468 is of a substantially constant thickness, front to back, along about 85 percent of its length.

INDUSTRIAL APPLICABILITY

The industrial application of a wear member such as the end cutting-bit as described herein should be readily appreciated from the foregoing discussion. The present disclosure can be applicable to any machine utilizing an earth-working implement for digging, scraping, leveling, excavating or any other suitable application involving engaging the ground or other work material. In machines used for such applications, end cutting-bits and other types of ground engaging tools can wear out quickly and require replacement.

The present disclosure, therefore, can be applicable to many different machines and environments. One exemplary use of the end cutting-bit of this disclosure can be in earth-moving applications in which machine implements can be commonly used to cut, scrape, dig, or clear various work materials including rock, gravel, sand, dirt, and others for protracted time periods and with little downtime. In such applications, reducing the machine passes necessary to clear a particular area can increase work efficiency and speed up the process of clearing the area. As described above, the end cutting-bit described herein can provide geometrical features that strike a favorable balance between applying a cutting force along the plane of a work surface, and applying a digging force along a plane perpendicular to a work surface. Such a balance can aide in machine fuel efficiency, as well as reducing work time. As such, the present disclosure has features, as discussed, which can reduce the time needed to clear a particular work area by reducing machine passes by up to half in some applications.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context.

Accordingly, this disclosure includes all modifications and equivalents of the subject matter recited in the claims appended hereto as permitted by applicable law. Moreover, any combination of the above-described elements in all possible variations thereof is encompassed by the disclosure unless otherwise indicated herein or otherwise clearly contradicted by context.

What is claimed is:

1. A wear member for an earth-working implement, the wear member comprising:

a body having front, rear, top, bottom, inner side and outer side portions, wherein a cutting edge is defined along at least a portion of a bottom interface between the front portion and the bottom portion;

a contoured upper front surface defined on the front portion, the contoured upper front surface extending between:

a top edge disposed along a top interface between the front portion and the top portion, an outer side edge disposed along an outer side interface between the front portion and the outer side portion, a ridge disposed on the front portion, and a spearhead edge disposed along the bottom interface between the outer side portion and the cutting edge;

a contoured lower front surface formed on the front portion of the body adjacent the contoured upper front surface, the contoured lower front surface defined between an inner side edge, which is disposed along an inner side interface between the front portion and the inner side portion, the cutting edge, and the ridge; and a rear surface defined on the rear portion and defining a rear surface plane, the rear surface plane substantially parallel to a normal-lateral plane, wherein a spearhead vertical angle, measured between the normal-lateral plane and the contoured upper front surface adjacent the spearhead edge, is in a range between about 10 degrees and about 25 degrees.

2. The wear member of claim 1, wherein a ratio of a spearhead edge length, measured along a lateral axis between the outer side edge and the cutting edge, and a top edge length, measured along the lateral axis between the outer side edge and the inner side edge, is less than about 1:10.

3. The wear member of claim 1, wherein a ratio of a spearhead edge length, measured along a lateral axis between the outer side edge and the cutting edge, and a top edge length, measured along the lateral axis between the outer side edge and the inner side edge, is in a range between about 1:10 and about 1:20.

4. The wear member of claim 1 further comprising a rear surface defined on the rear portion and defining a rear surface plane, the rear surface plane substantially parallel to a normal-lateral plane, wherein a spearhead vertical angle, measured between the normal-lateral plane and the contoured upper front surface adjacent the spearhead edge, is in a range between about 0 degrees and about 30 degrees.

5. The wear member of claim 1 further comprising:

a bottom surface defined on the bottom portion of the body, the bottom surface extending between:

the cutting edge, the spearhead edge, an outer bottom edge disposed along an outer bottom interface between the bottom portion and the outer side portion, a rear bottom edge disposed along a rear bottom interface between the rear portion and the bottom portion, and an inner bottom edge disposed along an inner bottom interface between the bottom portion and the inner side portion;

wherein a spearhead edge angle, measured between the contoured upper front surface and the bottom surface with respect to the spearhead edge, is less than about 90 degrees.

6. The wear member of claim 1 further comprising:

a bottom surface defined on the bottom portion of the body, the bottom surface extending between:

the cutting edge, the spearhead edge, an outer bottom edge disposed along an outer bottom interface between the bottom portion and the outer side portion, a rear bottom edge disposed along a rear bottom interface between the rear portion and the bottom portion, and an inner bottom edge disposed along an inner bottom interface between the bottom portion and the inner side portion;

wherein a spearhead edge angle, measured between the contoured upper front surface and the bottom surface with respect to the spearhead edge, is in a range between about 10 degrees and about 45 degrees.

7. The wear member of claim 1, further comprising a rear surface defined on the rear portion aligned with a normal axis that is perpendicular to a longitudinal axis, wherein a ratio of a body depth, measured along the longitudinal axis between the rear surface and the spearhead edge, and an outer side height, measured along the normal axis between the spearhead edge and the top edge, is in a range between about 1:4 and about 1:2.

8. The wear member of claim 1, further comprising a rear surface defined on the rear portion and defining a rear surface plane, the rear surface plane substantially parallel to a normal-lateral plane, wherein the contoured upper front surface is disposed at an angle in a range between about 5 degrees and about 30 degrees with respect to the normal-lateral plane.

9. The wear member of claim 1, further comprising a rear surface defined on the rear portion aligned with a normal axis that is perpendicular to a longitudinal axis, the rear surface including a planar rear mounting surface configured to abuttingly mount to the earth-working implement and a relieved portion configured to be spaced-apart from the earth-working implement when the wear member is mounted thereto.

10. The wear member of claim 9, further comprising a concave rear bottom surface disposed on the rear portion below the rear mounting surface.

11. The wear member of claim 10, wherein a bottom surface is disposed between the cutting edge and defined at least in part by the shape of the concave rear bottom surface and wherein the bottom surface is of a substantially constant thickness, front to back.

12. The wear member of claim 1, further comprising a rear top bevel disposed between the top edge and a rear top edge.

13. A wear member for an earth-working implement, the wear member comprising:

a body having front, rear, top, bottom, inner side and outer side portions, wherein a cutting edge is defined along at least a portion of a bottom interface between the front portion and the bottom portion;

a contoured upper front surface defined on the front portion, the contoured upper front surface extending between:

a top edge disposed along a top interface between the front portion and the top portion, an outer side edge disposed along an outer side interface between the front portion and the outer side portion, a ridge disposed on the front portion, and a spearhead edge disposed along the bottom interface between the outer side portion and the cutting edge;

a bottom surface defined on the bottom portion of the body, the bottom surface extending between:

the spearhead edge;

the cutting edge;

an outer bottom edge disposed along an outer bottom interface between the bottom portion and the outer side portion;

a rear bottom edge disposed along a rear bottom interface between the rear portion and the bottom portion; and an inner bottom edge disposed along an inner bottom interface between the bottom portion and the inner side portion wherein the contoured upper front surface has a generally concave shape, and wherein a spearhead edge angle, measured between the contoured upper front surface and the bottom surface with respect to the spearhead edge, is less than about 90 degrees.

14. The wear member of claim 13, further comprising a rear surface defined on the rear portion and defining a rear surface plane, the rear surface plane substantially parallel to a normal-lateral plane, wherein a spearhead vertical angle, measured between the normal-lateral plane and the contoured upper front surface adjacent the spearhead edge, is in a range between about 0 degrees and about 30 degrees.

15. The wear member of claim 13, further comprising a rear surface defined on the rear portion and defining a rear surface plane, the rear surface plane substantially parallel to a normal-lateral plane, wherein a spearhead vertical angle, measured between the normal-lateral plane and the contoured upper front surface adjacent the spearhead edge, is in a range between about 10 degrees and about 25 degrees.

16. The wear member of claim 13, further comprising a rear surface defined on the rear portion aligned with a normal axis that is perpendicular to a longitudinal axis, wherein a ratio of a body depth, measured along the longitudinal axis between the rear surface and the spearhead edge, and an outer side height, measured along the normal axis between the spearhead edge and the top edge, is in a range between about 1:4 and about 1:2.

17. The wear member of claim 13, further comprising a rear surface defined on the rear portion aligned with a normal axis that is perpendicular to a longitudinal axis, wherein a ratio of a body depth, measured along the longitudinal axis between the rear surface and the spearhead edge, and an outer side height, measured along the normal axis between the spearhead edge and the top edge, is in a range between about 2:5 and about 1:2.

18. The wear member of claim 13, where in a rear surface defined on the rear portion and defining a rear surface plane, the rear surface plane substantially parallel to a normal-lateral plane, and wherein the contoured upper front surface is disposed at an angle in a range between about 5 degrees and about 30 degrees with respect to the normal-lateral plane.

19. The wear member of claim 17, wherein a spearhead edge angle, measured between the contoured upper front surface and the bottom surface with respect to the spearhead edge, is in a range between about 10 degrees and about 45 degrees.

20. The wear member of claim 13, wherein a ratio of a spearhead edge length, measured along a lateral axis between the outer side edge and the cutting edge, and a top edge length, measured along the lateral axis between the outer side edge and the inner side portion, is less than about 1:10.

21. A wear member system for an earth-working implement, the wear member system comprising:

at least one end cutting-bit adapted to be mounted to a mounting edge of an earth-working blade, the mounting edge defined between a first blade end and a second blade end, wherein the at least one end cutting-bit comprises:

a body having front, rear, top, bottom, inner side and outer side portions, wherein a cutting edge is defined along at least a portion of a bottom interface between the front portion and the bottom portion;

a contoured upper front surface defined on the front portion, the contoured upper front surface extending between:

a top edge disposed along a top interface between the front portion and the top portion, an outer side edge disposed along an outer side interface between the front portion and the outer side portion, a ridge disposed on the front portion, and a spearhead edge disposed along the bottom interface between the outer side portion and the cutting edge; and a contoured lower front surface formed on the front portion of the body adjacent the contoured upper front surface, the contoured lower front surface defined between an inner side edge, which is disposed along an inner side interface between the front portion and the inner side portion, the cutting edge, and the ridge; and at least one intermediate cutting-edge adapted to be mounted along the mounting edge of the earth-working blade between the first blade end and the second blade end.

22. The wear member of claim 21, further comprising a rear surface defined on the rear portion aligned with a normal axis that is perpendicular to a longitudinal axis, wherein a ratio of a body depth, measured along the longitudinal axis between the rear surface and the spearhead edge, and an outer side height, measured along the normal axis between the spearhead edge and the top edge, is in a range between about 1:4 and about 1:2.

* * * * *